US012729043B2

(12) United States Patent
Yamada

(10) Patent No.: US 12,729,043 B2
(45) Date of Patent: Sep. 8, 2026

(54) LID

(71) Applicant: Kikuo Yamada, Tokyo (JP)

(72) Inventor: Kikuo Yamada, Tokyo (JP)

( * ) Notice: Subject to any disclaimer, the term of this patent is extended or adjusted under 35 U.S.C. 154(b) by 455 days.

(21) Appl. No.: 17/631,283

(22) PCT Filed: Jul. 30, 2020

(86) PCT No.: PCT/JP2020/029245
§ 371 (c)(1),
(2) Date: Jan. 28, 2022

(87) PCT Pub. No.: WO2021/020511
PCT Pub. Date: Feb. 4, 2021

(65) Prior Publication Data

US 2022/0258932 A1 Aug. 18, 2022

Related U.S. Application Data

(60) Provisional application No. 62/886,670, filed on Aug. 14, 2019, provisional application No. 62/880,356, filed on Jul. 30, 2019.

(51) Int. Cl.
*B65D 47/36* (2006.01)
*B65D 3/26* (2006.01)

(52) U.S. Cl.
CPC ..... *B65D 47/36* (2013.01); *B65D 3/268* (2013.01)

(58) Field of Classification Search
CPC .... B65D 53/08; B65D 47/36; B65D 43/0212; B65D 3/268; B65D 2543/00268;
(Continued)

(56) References Cited

U.S. PATENT DOCUMENTS 3,977,562 A * 8/1976 Wedzik ..... B65D 47/103 229/123.1
3,990,603 A * 11/1976 Brochman ..... B65D 17/505 222/541.9
(Continued)

FOREIGN PATENT DOCUMENTS

EP 2412644 B1 3/2014
GB 2174061 A * 10/1986 ..... B65D 17/503
(Continued)

OTHER PUBLICATIONS

International Search Report and Written Opinion (machine translation only) issued Sep. 24, 2020 in PCT/JP2020/029245 filed Jul. 30, 2020, 6 pages.
(Continued)

*Primary Examiner* — James N Smalley
*Assistant Examiner* — Madison L Poos
(74) *Attorney, Agent, or Firm* — Oliff PLC

(57) ABSTRACT

A lid that closes a mouth of a container is made of a material principally including a paper material. The lid includes a side wall that is fitted into the mouth of the container, and a top lid that is surrounded by the side wall. The top lid includes an inlet/outlet formation part that forms an inlet/outlet for an article stored in the container, and a temporary fixing part that temporarily fixes the inlet/outlet formation part to the top lid. This can achieve a lid that has satisfactory thermal insulation, can reduce leakage, is user-friendly, can reduce a manufacturing cost, and is conscious of environmental issues.

23 Claims, 15 Drawing Sheets

(58) Field of Classification Search
CPC .. B65D 2543/00046; B65D 2543/2517; B65D 2543/5089; B65D 2517/0085; B65D 2517/0013
USPC ..... 220/266, 268, 269, 270
See application file for complete search history.

(56) References Cited

U.S. PATENT DOCUMENTS

| | | | | | |
|---|---|---|---|---|---|
| 4,108,330 | A * | 8/1978 | Patterson | B65D 17/505 220/269 |
| 4,189,060 | A * | 2/1980 | Trotman, III | B65D 17/505 220/269 |
| 4,325,490 | A * | 4/1982 | Conrad | B65D 17/4012 220/269 |
| 4,433,808 | A * | 2/1984 | Gordon | B65D 43/161 229/125.13 |
| 4,556,152 | A | 12/1985 | Bogren | |
| 4,971,218 | A | 11/1990 | Buchner et al. | |
| 5,647,500 | A * | 7/1997 | Konno | B65D 5/708 229/123.1 |
| 11,685,576 | B2 * | 6/2023 | Takano | B65D 43/0212 220/266 |
| 2002/0195471 | A1 | 12/2002 | Nottingham et al. | |
| 2014/0054306 | A1 | 2/2014 | Panek et al. | |
| 2021/0316912 | A1 | 10/2021 | Yamada | |

FOREIGN PATENT DOCUMENTS

| | | | | |
|---|---|---|---|---|
| JP | 60-501305 | A | 8/1985 | |
| JP | 9-99946 | A | 4/1997 | |
| JP | 11-105849 | A | 4/1999 | |
| JP | 2002-211617 | A | 7/2002 | |
| JP | 2006-248530 | A | 9/2006 | |
| JP | 2014061948 | A * | 4/2014 | |
| JP | 2016-169023 | A | 9/2016 | |
| KR | 10-2011-0134489 | A | 12/2011 | |
| WO | WO-2017029997 | A1 * | 2/2017 | B65D 5/70 |
| WO | WO 2020/166715 | A1 | 8/2020 | |

OTHER PUBLICATIONS

Indian Office Action issued on Jan. 5, 2023 in Indian Patent Application No. 202217004240, 5 pages.
May 8, 2026 Office Action issued in Korean Patent Application No. 10-2025-7007838.

* cited by examiner (a)

(b)

(a)

(b)

(a)

(b)

(a)

(b)

(a)

(b)

LID

TECHNICAL FIELD

The present invention relates to a lid that has been formed to be mountable on a container.

BACKGROUND ART

Conventionally, a lid has been mounted on a container in order to close a mouth formed in the container and avoid leakage to the outside of various articles stored in the container that serve as the contents of the container. In general, the lid is mounted on the container in an internally or externally fitted manner, and tightly seals an internal space inside the container.

Various aspects can be considered as the various articles stored in the container. Examples include powdery articles, granular articles, solid articles, and the like. Another example is liquid articles such as various beverages of food and beverage. Among these various articles stored in the container, liquid articles such as beverages easily leak out. In particular, in a case where liquid having a low viscosity is stored, it is requested that a container be tightly sealed with a lid with more precision.

In addition, in recent years, an opportunity to use a container holding a beverage has been increasing, in particular, in takeout, delivery service, or the like. Therefore, it is requested that a lid having higher sealability be used in order to prevent a beverage in a container from leaking out. As an example of such a lid of a beverage container, a lid having the configuration described in Patent Literature 1 listed below has been disclosed. As the lid of the beverage container, a plastic lid that has been formed to be mountable on a container mouth has been disclosed.

CITATION LIST

Patent Literature

Patent Literature 1: JP 2016-169023 A

SUMMARY OF INVENTION

Technical Problem

If a plastic material is used, as described as a lid for beverages in Patent Literature 1 listed above, the lid is molded by using various molding machines in vacuum molding or the like, and therefore a thickness is likely to decrease. If a thickness of a lid decreases, as described above, in a case where the contents of a container is a beverage or the like that has a high temperature, the heat of the beverage that has flown out from an opening is easily transferred to the lid, and this causes a problem in which a user easily feels heat and is likely to feel uncomfortable. In particular, in the case of use as a lid for beverages, human lips are sensitive to temperature, and this causes a problem in which a user is more likely to feel uncomfortable. In order to solve this problem, it is conceivable that the thickness of a plastic material is increased. However, in this case, an amount of a plastic material serving as a raw material increases, and this results in an increase in weight. This causes a problem in which a user feels heavy, and also causes a problem of an increase in a manufacturing cost. In addition, in a case where a lid is formed by using a plastic material, a position of an opening serving as a mouth for drinking needs to be located closer to the center from the viewpoint of molding. In this case, if such a lid is used as a lid for beverages, it becomes difficult for a beverage in a container to flow out from an opening serving as a mouth for drinking of the lid, and this also causes a problem in which it is difficult to drink all of the beverage in the container.

On the other hand, in recent years, importance has been placed on environmental issues, and there has been a trend toward a strong request for the use of an environment-friendly material. In contrast, it cannot be said that a lid that has been formed by using a plastic material, as described in Patent Literature 1 listed above, is environmental-friendly, and in recent years, it has been requested that a lid be formed by using a material in more consideration of environmental issues. In this point and in particular, in a point that environmental issues are taken into consideration, in recent years, there has been a trend toward considering the formation of a container using a paper material. However, even if a paper material is used as material, when only an opening is formed or when a sticker member or the like is stuck on this opening so that the opening is tightly sealed, there has been a problem of a bad thermal insulation effect. In addition, there has been a problem in which a paper material makes a lid soft, and a beverage serving as the contents of a container jets out from the opening when the sticker member is peeled off and the opening is exposed. In addition, when a straw or the like is inserted, in a case where an opening is larger than a thickness of the straw, there has been a problem in which a beverage easily spills due to inclination or wobbling.

The present invention has been made in view of such problems, and it is an object of the present invention to form a lid that has satisfactory thermal insulation, can reduce leakage, is user-friendly, can reduce a manufacturing cost, and is conscious of environmental issues.

Solution to Problem

The gist of the present invention is:

(1) A lid that closes a mouth of a container, and is made of a material principally including a paper material, the lid including: a side wall that is fitted into the mouth of the container; and a top lid that is surrounded by the side wall, in which the top lid includes: an inlet/outlet formation part that forms an inlet/outlet for an article stored in the container; and a temporary fixing part that temporarily fixes the inlet/outlet formation part to the top lid;

(2) The lid according to (1) described above, in which the top lid includes a cutout between an inner edge of the inlet/outlet and an outer edge of the inlet/outlet formation part;

(3) The lid according to (2) described above, in which the top lid includes a top lid edge in a position closer to the side wall than the inlet/outlet formation part, and the cutout is formed between the outer edge of the inlet/outlet formation part and an inner edge of the top lid edge;

(4) The lid according to (3) described above, in which the temporary fixing part is formed over the inlet/outlet formation part, the cutout, and the top lid edge;

(5) The lid according to (1) described above, in which the temporary fixing part is temporarily fixed to surfaces of the inlet/outlet formation part and the top lid;

(6) The lid according to (2) described above, in which the cutout has a predetermined width between the inner edge of the inlet/outlet and the outer edge of the inlet/outlet formation part, and a width of the cutout in a portion where the temporary fixing part is formed is different from a width of the cutout in a portion where the temporary fixing part is not formed;

(7) The lid according to (6) described above, in which the width of the cutout in the portion where the temporary fixing part is formed is smaller than the width of the cutout in the portion where the temporary fixing part is not formed;

(8) The lid according to (2) described above, in which the inner edge of the inlet/outlet is in contact with the outer edge of the inlet/outlet formation part in a portion where the temporary fixing part is formed;

(9) The lid according to (3) described above, in which the top lid edge includes a guiding path that guides the article stored in the container toward the inlet/outlet, the article having come out from the inlet/outlet;

(10) The lid according to (1) described above, in which the joint is formed by performing ultrasonic joining;

(11) The lid according to (9) described above, in which the guiding path is formed in a groove shape by performing ultrasonic joining;

(12) The lid according to (1) described above, in which the inlet/outlet formation part is mounted with a sticker member, and one end of the sticker member is temporarily fixed together with the inlet/outlet formation part and the top lid by the temporary fixing part;

(13) The lid according to (1) described above, in which the inlet/outlet formation part is provided in a position where an opening end of the container is visibly recognizable;

(14) The lid according to (1) described above, in which the inlet/outlet formation part includes a closing piece that closes the inlet/outlet formation part;

(15) The lid according to (14) described above, in which the closing piece is formed to be opened/closed by using a hinge;

(16) The lid according to (15) described above, in which the hinge includes a bending line;

(17) The lid according to (15) described above, in which the closing piece includes a dot-shaped joint or a half-cut part in a circumference excluding the hinge in the top lid;

(18) The lid according to (17) described above, in which in the closing piece, a sticker member causes the dot-shaped joint or the half-cut part to be cut, and the inlet/outlet is formed;

(19) The lid according to (15) described above, in which the closing piece includes a stress reduction part on a base end side where the hinge is formed, the stress reduction part reducing a stress generated against a force applied when the closing piece is pulled up;

(20) The lid according to (15) descried above, in which in the closing piece, a width on a front end side in a position away from the hinge is greater than a width on a base end side where the hinge is formed;

(21) The lid according to (15) described above, in which in the closing piece, a width on a base end side where the hinge is formed is the same as a width on a front end side in a position away from the hinge;

(22) The lid according to (19) descried above, in which the stress reduction part includes a cutout that disperses the stress, and the cutout is formed to extend in a direction that is different from a direction of a force applied to the closing piece, at an end on the base end side;

(23) The lid according to (1) described above, in which a bending line is formed in a position close to the side wall of the inlet/outlet formation part;

(24) The lid according to (12) described above, in which the sticker member is mounted in a position that deviates from a center of the inlet/outlet formation part;

(25) The lid according to (12) described above, in which the inlet/outlet formation part is provided in a position that deviates from a center of the top lid, and the sticker member is mounted in a position away from the center of the top lid in the inlet/outlet formation part;

(26) The lid according to (12) described above, in which the sticker member is mounted in a position that is farthest from a center of the top lid in the inlet/outlet formation part;

(27) The lid according to (12) described above, in which the sticker member includes one end that is mounted in the inlet/outlet formation part, and another end that faces the one end, and the another end is mounted on a surface of the top lid in a peelable state;

(28) The lid according to (27) described above, in which the another end is mounted on the surface of the top lid in the peelable state in a predetermined position that is closer to the one end by a predetermined distance from the another end of the sticker member, and the another end includes a tab;

(29) The lid according to (28) described above, in which the tab is formed as a non-joint that is not joined to the surface of the top lid;

(30) The lid according to (27) described above, in which the another end is formed to be mountable again after being peeled off from the surface of the top lid;

(31) The lid according to (27) described above, in which in the sticker member, a mounting strength at the one end is greater than a mounting strength at the another end;

(32) The lid according to (1) described above, in which the inlet/outlet formation part is formed by performing a punching process;

(33) The lid according to (32) described above, in which a thickness of a punching blade in the punching process is 1.0 mm or less;

(34) The lid according to (12) described above, in which the sticker member is provided to cover at least part of the inlet/outlet formation part;

(35) The lid according to (12) described above, in which the sticker member has a width that is greater than or equal to a width of the inlet/outlet formation part;

(36) The lid according to (12) described above, in which the sticker member is disposed to cause the one end to extend over one end of the inlet/outlet formation part;

(37) The lid according to (12) described above, in which the sticker member includes a portion where the one end is joined to a surface of the top lid; and

(38) The lid according to (12) described above, in which the sticker member includes a portion where the one end is not joined to a surface of the top lid.

Advantageous Effects of Invention

According to the present invention, a lid that closes a mouth of a container is made of a material principally including a paper material. The lid includes: a side wall that is fitted into the mouth of the container; and a top lid that is surrounded by the side wall. The top lid includes: an inlet/outlet formation part that forms an inlet/outlet for an article stored in the container; and a temporary fixing part that temporarily fixes the inlet/outlet formation part to the top lid. This can make it difficult for an article stored in the container to leak out to the outside. In addition, the lid can be user-friendly for the purpose, and a manufacturing cost can be significantly reduced. Further, according to the present invention, a lid that is conscious of environmental issues can be provided.

DESCRIPTION OF EMBODIMENTS

Figure 1:
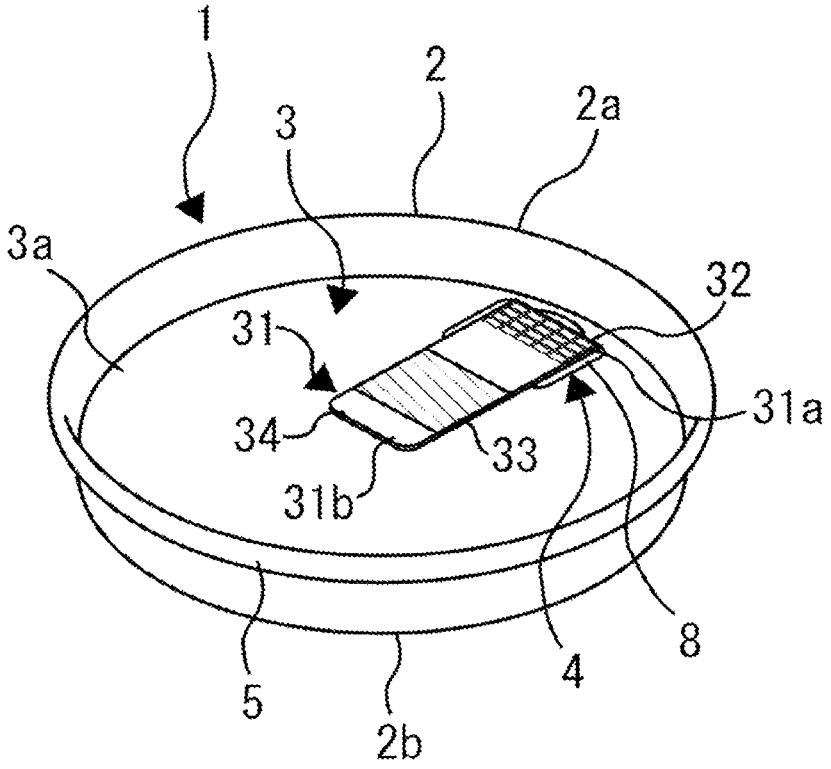
FIG. 1 is external perspective views illustrating a first embodiment of a lid according to the present invention, (a) is a view illustrating a state where an inlet/outlet formation part is closed, and (b) is a view illustrating a state where the inlet/outlet formation part is open.
Figure 1:
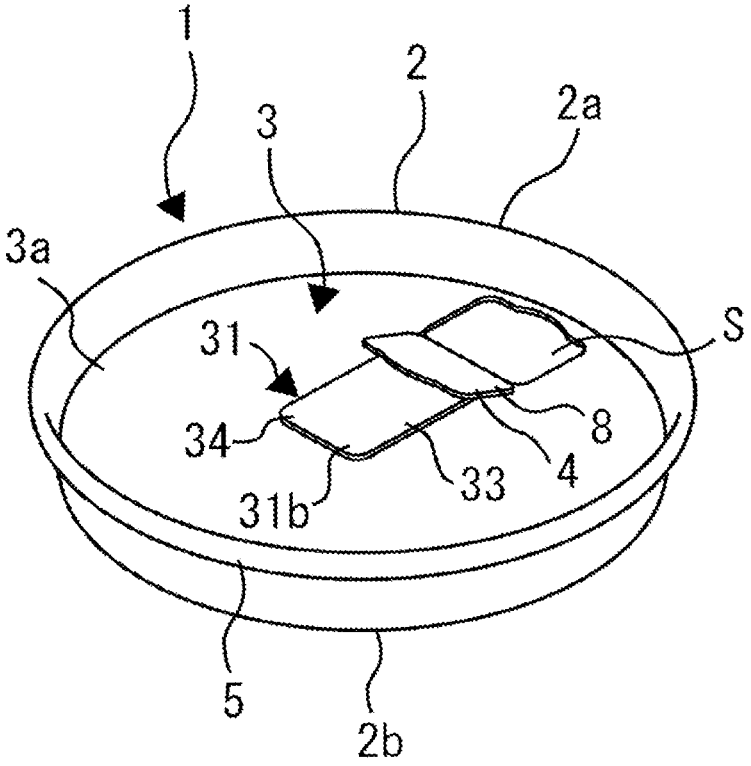
Figure 2:
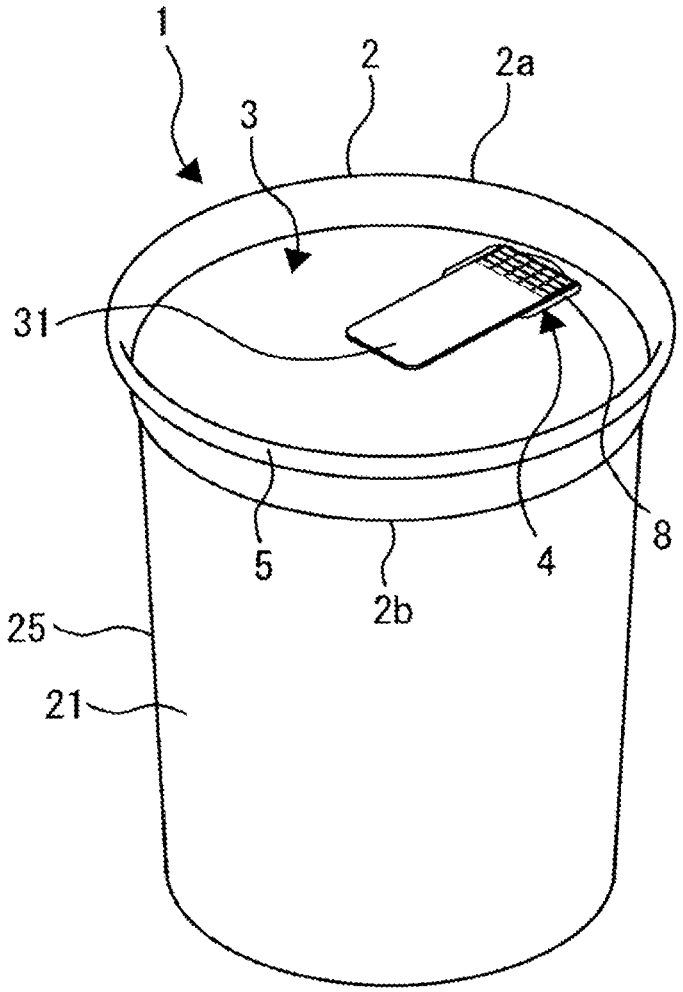
FIG. 2 is an external perspective view illustrating a state where the lid has been mounted on a container.

First, a material of a lid according to the present invention is described. A lid according to the present invention is formed by using a material principally including a paper material. Here, examples of the paper material include what is called paper that has been manufactured by sticking, for example, vegetable fiber or other fiber, chemical fiber paper, synthetic paper, waterproof paper, coated paper, substitute paper, parchment, wool paper, glass fiber paper, stone paper, ceramic paper, and the like. The paper material is preferably a material including a cellulose component such as pulp, more preferably a material including 50% or more by weigh of the cellulose component, further more preferably a material including 60% or more by weigh of the cellulose component, further more preferably a material including 70% or more by weigh of the cellulose component, especially preferably a material including 80% or more by weigh of the cellulose component, and most preferably a material including 90% or more by weigh of the cellulose component.

Here, examples of pulp include wood pulp, non-wood pulp, synthetic pulp, and waste paper pulp. More specifically, one or several types can be appropriately selected and used from ground wood pulp (GP), stone ground pulp (SGP), refiner ground pulp (RGP), pressurized ground wood pulp (PGW), mechanical pulp (MP) such as thermomechanical pulp (TMP), chemithermomechanical pulp (CTMP), bleached chemithermomechanical pulp (BCTMP), or the like, chemimechanical pulp (CGP), semichemical pulp (SCP), kraft pulp (KP) such as leaf bleached kraft pulp (LBKP), needle bleached kraft pulp (NBKP), or the like, chemical pulp (CP) such as soda pulp (AP), sulfite pulp (SP), dissolving pulp (DP), or the like, synthetic pulp using, as a raw material, nylon, rayon, polyester, polyvinyl alcohol (PVA), or the like, tailings pulp (TP), rag pulp using, as a raw material, cotton, flax, hemp, jute, Manila hemp, ramie, or the like, stem pulp such as straw pulp, esparto pulp, bagasse pulp, bamboo pulp, kenaf pulp, or the like, auxiliary pulp such as bast pulp or the like, and the like.

In addition, as the paper material, a paper material including a resin coated layer at least on one side may be used. In a case where a paper material including a coated layer is used, it is preferable that the coated layer be located at least on an inner face side of a container. The coated layer can be formed by using the resin film or a coating agent. In a case where the coated layer is formed by sticking a resin film, the film may be a monolayer film or a multilayer film, and the coated layer may be formed by superimposing and sticking monolayer or multilayer films. In addition, the coated layer may be formed not only by coating one type of coating agent but also by superimposing and coating two or more types of coating agents.

As a resin forming the coated layer, for example, the following can be used: polystyrene, polyethylene, polypropylene, polyethylene terephthalate, polyurethane, polyvinyl chloride, polyvinylidene chloride, polyvinyl acetate, cyanoacrylate, epoxy resin, polyacrylic acid resin, polymethacrylic acid resin, nylon, polycarbonate; a naturally degradable resin such as polycaprolactone, polyhydroxyalkanoate, polyhydroxybutyrate, polylactic acid, a starch-based resin such as an esterified starch or the like, cellulose acetate, polyethylene succinate, polyvinyl alcohol, polyglycolic acid, chitosan/cellulose/starch, poly(hydroxybutyrate/hydroxyhexanoate), poly(caprolactone/butylene succinate), polybutylene succinate, poly(butylene succinate/adipate), poly(butylene succinate/carbonate), poly(ethylene terephthalate/succinate), poly(butylene adipate/terephthalate), poly(tetramethylene adipate/terephthalate), or the like or a naturally degradable resin mixture; a naturally degradable biomass resin or a naturally degradable biomass resin mixture; fluororesin, silicone resin, an ultraviolet curing resin, a monomer copolymer constituting the resin described above, such as an ethylene-vinyl acetate copolymer, an ethylene-vinyl alcohol copolymer, an ethylene-propylene copolymer, an ethylene-propylene-butadiene copolymer, an acrylic-styrene copolymer, a styrene-butadiene copolymer, an acrylonitrile-butadiene-styrene copolymer, or the like, a natural resin, paraffin, gelatin, cellophane, polymethylpentene, and the like. It is preferable that the coated layer be formed by using a naturally degradable resin, a naturally degradable biomass resin, a naturally degradable resin such as a natural resin or the like, or a combination thereof.

Examples of the naturally degradable resin include a natural resin, naturally degradable plastic, biomass plastic, and the like. Examples of naturally degradable plastic and biomass plastic include a naturally degradable resin such as polycaprolactone, polyhydroxyalkanoate, polyhydroxybutyrate, polylactic acid, a starch-based resin such as an esterified starch or the like, cellulose acetate, polyethylene succinate, polyvinyl alcohol, polyglycolic acid, chitosan/cellulose/starch, poly(hydroxybutyrate/hydroxyhexanoate), poly(caprolactone/butylene succinate), polybutylene succinate, poly(butylene succinate/adipate), poly(butylene succinate/carbonate), poly(ethylene terephthalate/succinate), poly(butylene adipate/terephthalate), poly(tetramethylene adipate/terephthalate), or the like, and a naturally degradable resin mixture.

In addition, the naturally degradable resin may contain an additive listed in a positive list of Japan BioPlastics Association, for example, lubricant such as a stearic acid amide, a fatty acid ester, fatty acid metal salt, fatty acid, oil, a glyceryl fatty acid ester, or the like; stabilizer such as triphenyl phosphate, phthalic anhydride, tris dibutyl phosphate, acetic anhydride, or the like; an inorganic material such as titanium dioxide, kaolin, mica, bentonite, diatomaceous earth, magnesium oxide, silica sand aluminum, calcium carbonate, calcium hydroxide, seashell powder, or the like; surfactant such as a higher fatty acid amide, nonionic surfactant, a glycerol fatty acid ester, or the like; a foaming agent such as citric acid, sodium hydrogen carbonate, butane, or the like; another material such as an antistatic agent, a hot-melt adhesive, or the like; and the like.

In addition, "naturally degradable" means a property of being degradable due to a microorganism, ultraviolet rays, a change in a climate, or the like in any of the air, soil, and water to reduce a burden on the environment. Further, a lid according to the present invention is not restricted by the contents of a container on which the lid is mounted, but can be applied to a lid that closes a container that can hold any type of contents.

First Embodiment

Next, a first embodiment of a lid 1 according to the present invention is described in detail with reference to the drawings. Note that the lid 1 according to the present invention is described by using, as an example, a lid 1 that is applied to a container (a cup) that holds various beverages, such as a coffee cup. However, the lid 1 according to the present invention is not limited to a lid 1 of a container that holds beverages, and can also be applied to a lid 1 of a container that stores food rather than beverages. In addition, the lid 1 according to the present invention can be applied as a lid 1 that is applied to a container that stores various articles other than food, for example, parts such as bolts or nuts, or articles other than the above. Further, the lid 1 according to the present embodiment is described by using, as an example, a lid having a circular shape in a plan view. However, a shape of the lid 1 is not limited to a circular shape, and may be a polygonal shape or various shapes that can be arbitrarily set rather than the polygonal shape.

As illustrated in FIGS. 1(*a*) and 1(*b*), the lid 1 includes a side wall 2 that is fitted into a mouth 22 (see FIG. 4) of a container 21, and a top lid 3 that is surrounded by the side wall 2. The top lid 3 includes an inlet/outlet formation part 4 of the contents that serve as an article stored in a container and are stored in an inside 23 (see FIG. 4) of the container 21 (in the present embodiment, description is provided by using beverages, but the contents may be an article other than beverages, for example, food or an article other than food and beverage). In addition, the inlet/outlet formation part 4 has been mounted with a sticker member 31.

The side wall 2 has been formed to surround a peripheral edge 3*c* of the top lid 3. As illustrated in FIG. 1(*a*), the side wall 2 has been formed in a taper shape in which a dimension decreases toward a lower end 2*b* from an upper end 2*a*. In addition, in the side wall 2, a projection part 5 has been formed at the upper end 2*a*. The projection part 5 has been formed to protrude outward from the side wall 2. Further, in the present embodiment, the projection part 5 has been formed by winding a paper material constituting the side wall 2 to be formed in a curled shape. However, the projection part 5 does not always need to be formed in a curled shape. For example, the projection part 5 may be formed by generating a curled shape and vertically crushing the curled shape. Alternatively, the projection part 5 may be formed by bending a paper material forming the side wall 2 to cause the paper material to extend outward from the upper end 2*a*. In addition, the upper end 2*a* may have a shape obtained by folding back the paper material forming the side wall 2. Further, a shape other than the shapes described above may be used. As described above, by forming the projection part 5, the entire strength of the side wall 2 cannot only be increased, but a user can also easily drink a beverage in the container 21. Note that in the present embodiment, description has been provided by using an example where the projection part 5 has been formed to protrude outward from the side wall 2, but the projection part 5 may be formed to protrude inward from the side wall 2.

Figure 4:
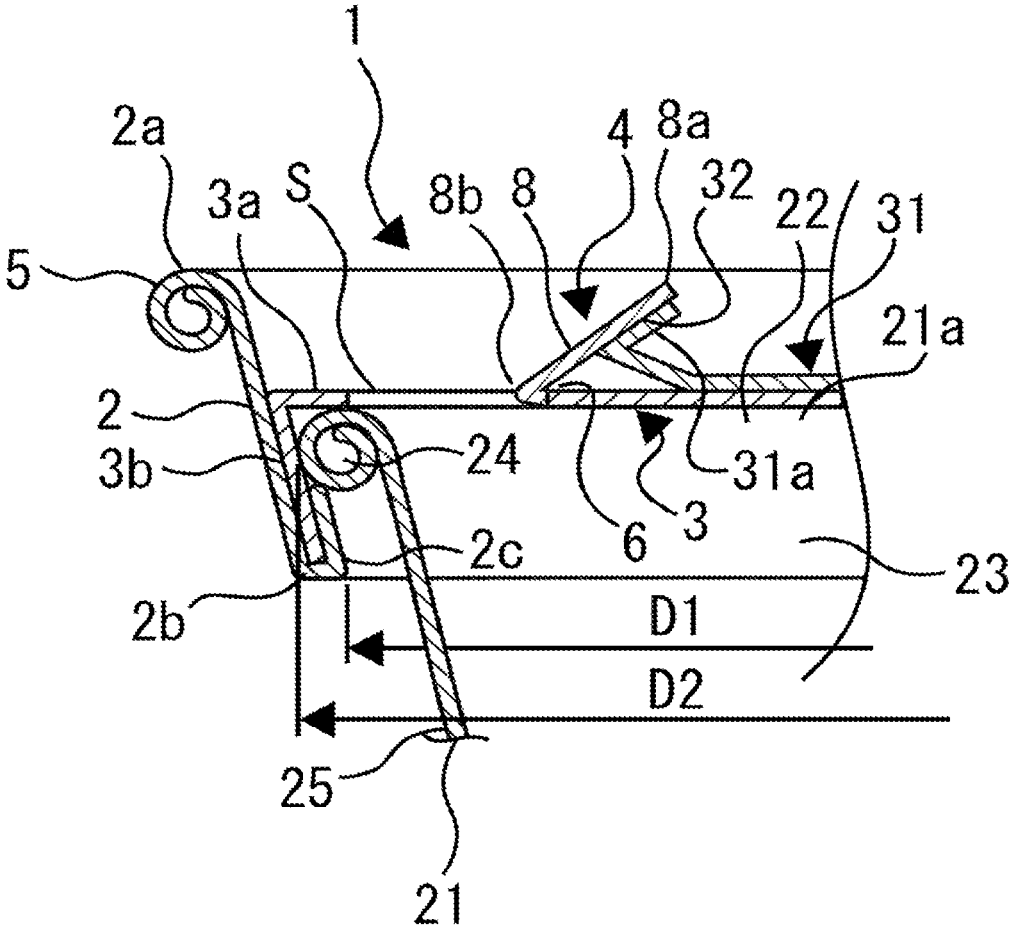
FIG. 4 is a partially enlarged sectional view illustrating the lid mounted on the container.

In addition, the lower end side 2*b* of the side wall 2 is joined to the peripheral wall 3*b* described below of the top lid 3. The lower end side 2*b* and the peripheral wall 3*b* can be joined by arbitrarily selecting a conventionally known joining method such as heat sealing, ultrasonic joining, thermal fusion, or joining using an adhesive. Note that this joining method is not limited to the methods described above, and a method other than these methods may be used. In addition, as illustrated in FIG. 4, the peripheral wall 3*b* that has been formed in a periphery of the top lid 3 is sandwiched between the side wall 2 and a bent piece 2*c* formed by bending the lower end side 2*b* of the side wall 2 in an inward direction, and joining is performed.

As described above, by joining the lower end side 2*b* of the side wall 2 and the peripheral wall 3*b*, a strength of the entirety of the lid 1 can be significantly improved, and a strength of the lower end side 2*b* of the side wall 2 that serves as a portion that is fitted into the container 21 can also be increased. Stated another way, on the lower end side 2*b*, three paper materials, the lower end side 2*b* of the side wall 2, the peripheral wall 3*b*, and the bent piece 2*c* in this order from an outside, are stacked and are integrally joined. Therefore, an increase in thickness enables an increase in strength. In addition, as is obvious from FIG. 4, the lid 1 according to the present embodiment has been formed in such a way that an inner dimension D1 at the lower end 2*b* of the side wall 2 is smaller than an outer dimension D2 at an upper end 21*a* of the container 21. Therefore, when the lid 1 is mounted on the container 21, the lid 1 is elastically transformed, and is fitted into the upper end 21*a* of the container 21. When the lid 1 has been mounted on the container 21, as described above, an outer face of a projection part 24 of the container 21 is in contact with an inner face of the peripheral wall 3*b* and a lower face of a top lid body 3*a* in the lid 1, as illustrated in FIG. 4, and the lid 1 can be reliably mounted on the container 21. In addition, in a case where the lid 1 has been mounted on the container 21, as described above, the lid 1 has a configuration in which two or three paper materials have been stacked. This can also make it difficult for the lid 1 to come off from the container 21.

Note that with respect to the lid 1 according to the present embodiment, an aspect has been described where on the lower end side 2*b* of the side wall 2, an inside face on the lower end side 2*b* of the side wall 2 is joined to an outside face of the peripheral wall 3*b*, and an inside face of the peripheral wall 3*b* is joined to an outside face of the bent piece 2*c*. However, this configuration is not restrictive. For example, only an outer face side of the peripheral wall 3*b* may be joined to the inside face of the lower end side 2*b* in the side wall 2, or an aspect other than the aspects described above may be employed. Further, in the present embodiment, the bent piece 2*c* has been formed to be joined to the inside face of the peripheral wall 3*b* from a portion near a center in a height direction of the inner face of the peripheral wall 3*b* to the lower end 2*b*. However, the bent piece 2*c* may be formed in such a way that an upper end of the bent piece 2*c* is located in a position in close contact with an upper edge of the peripheral wall 3*b* and a lower end of the bent piece 2*c* is located in a position of the lower end 2*b*, or the bent piece 2*c* may be formed in another position. Note that if the upper end of the bent piece 2*c* is located near the center in the height direction of the inner face of the peripheral wall 3*b*, as illustrated in FIG. 4, the upper end of the bent piece 2*c* is fitted into the projection part 24 of the container 21, and the container 21 can be reliably closed by using the lid 1.

Note that in the present embodiment, description has been provided by using an example where the side wall 2 has been formed in a circular shape, but an arbitrary shape other than the circular shape, such as an elliptical shape, may be used. In addition, for example, a polygonal shape, such as a rectangular shape or a hexagonal shape, may be used, or another shape may be used. Note that, in FIG. 4, a rising part 25 that forms a side wall of the container 21 has been formed to have the same taper angle as a taper angle of the side wall 2 of the lid 1, and stated another way, the rising part 25 has been formed to be parallel to the side wall 2, but this is not restrictive. For example, the rising part 25 may be formed to have a taper angle that is different from the taper angle of the side wall 2.

The top lid body 3*a* includes the inlet/outlet formation part 4 that penetrates through an inside and an outside of the top lid body 3*a* and forms an inlet/outlet for an article in the container. In addition, the sticker member 31 has been mounted on a surface of the inlet/outlet formation part 4. The peripheral wall 3*b* has been formed in a bent manner to surround a circumference of the top lid body 3*a*. An outer face of the peripheral wall 3*b* is joined to an inner face on the lower end side 2*b* of the side wall 2, and an inner face of the peripheral wall 3*b* is joined to an outer face of the bent piece 2*c*. The lid 1 has been formed by joining the side wall 2 and the top lid 3, as described above.

Next, the inlet/outlet formation part 4 is described. The inlet/outlet formation part 4 is formed to penetrate through the inside and the outside of the top lid body 3*a*. For example, in a case where the lid 1 has been mounted on the container 21, the inlet/outlet formation part 4 forms an inlet/outlet S for an article in the container (for example, a beverage, food and beverage, or the like) in the container 21. As illustrated in FIGS. 1(*a*) and 1(*b*) and FIGS. 5(*a*) and 5(*b*), the inlet/outlet formation part 4 is provided in a position that deviates from a center of the top lid body 3*a* of the top lid 3. In addition, the top lid 3 is provided with a closing piece 8 that closes the inlet/outlet formation part 4. In the closing piece 8, as illustrated in FIG. 4, one end 8*a* that is located away from a center is a free end, and another end 8*b* that is located close to the center is a fixed end. A hinge 6 has been formed at the other end 8*b*, and the closing piece 8 has been formed to be opened/closed by using the hinge 6. Stated another way, the inlet/outlet formation part 4 is configured in such a way that the one end 8*a* performs an operation to open or close relative to the top lid body 3*a* by using the hinge 6 at the other end 8*b* as a fulcrum. Note that when the closing piece 8 operates by using the hinge 6 as a fulcrum, as described above, it is preferable that a bending line 7 (see FIGS. 5(*a*) and 5(*b*)) be formed in the hinge 6. As described above, by forming the bending line 7 in the hinge 6, the inlet/outlet formation part 4 and more specifically, the closing piece 8 can easily perform an operation to open or close with the bending line 7 as a reference, and a position where the inlet/outlet formation part 4 and more specifically, the closing piece 8 will be bent can be determined in advance on the basis of a portion where the bending line 7 has been formed. This can avoid a situation where the inlet/outlet formation part 4 (the closing piece 8) is bent by using, as a fulcrum, a place where the bending line 7 has not been formed, and the inlet/outlet formation part 4 can be reliably bent in a portion where the bending line 7 has been formed. Note that the bending line 7 can be formed by performing linearly pressing using, for example, press molding. Stated another way, the bending line 7 can be formed by performing linearly pressing in a predetermined portion where the bending line 7 will be formed, by using a press molding machine or the like. The closing piece 8 is only bent in a specified place where the bending line 7 has been formed, as described above. Therefore, a variation in a bent position of the closing piece 8 can be significantly reduced. Note that in forming the bending line 7 described above, an arbitrary conventionally known method can be appropriately selected and used.

Figure 3:
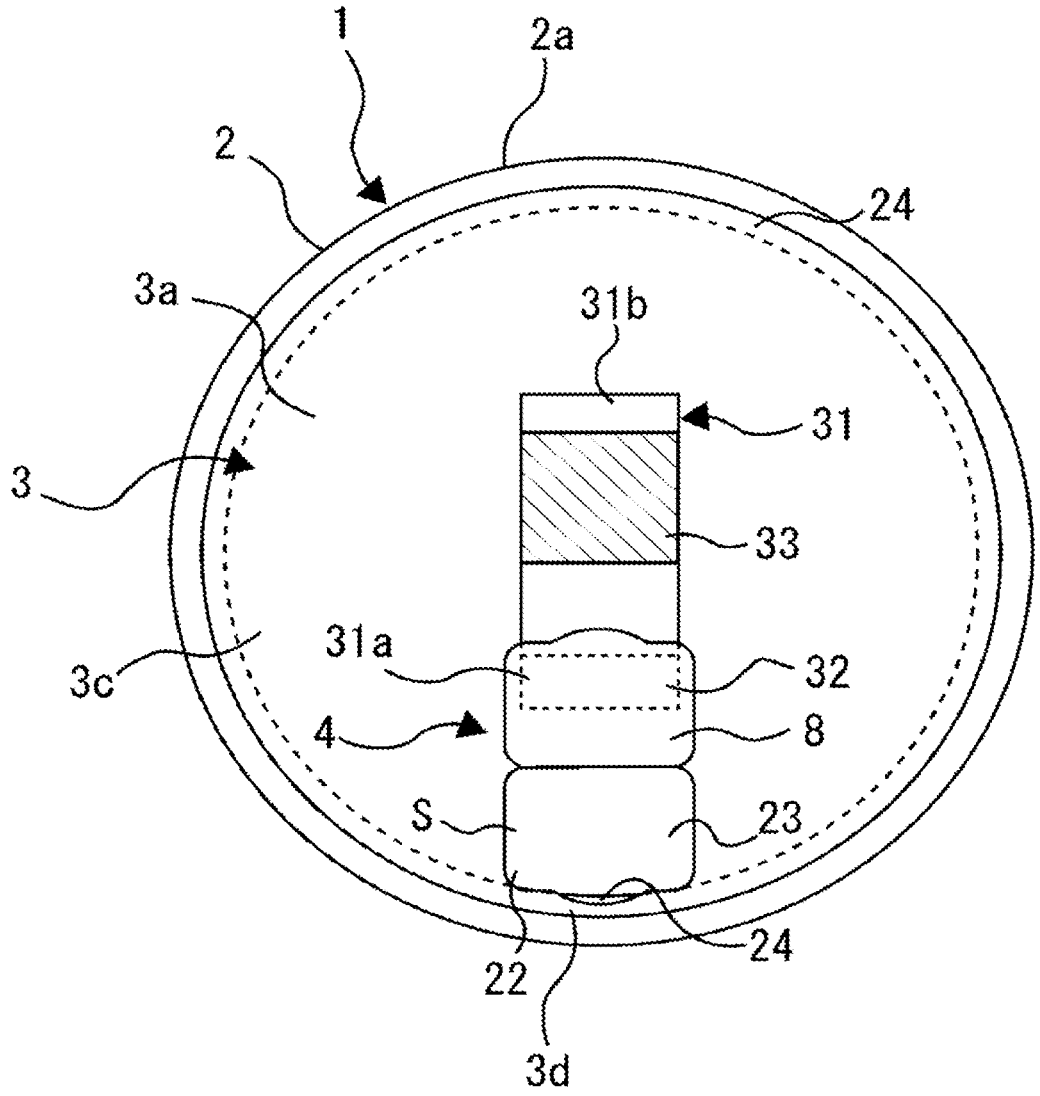
FIG. 3 is a plan view illustrating the lid mounted on the container.

When the closing piece 8 is opened in a state where the lid 1 has been mounted on the container 21, the inlet/outlet formation part 4 is located in a position where the projection part 24 of the container and the mouth 22 and the inside 23 inside the projection part 24 can be visually recognized on a front end side of the inlet/outlet S and in other words, on an end side close to a periphery of the top lid body 3*a*, as illustrated in FIG. 3.

Figure 5:
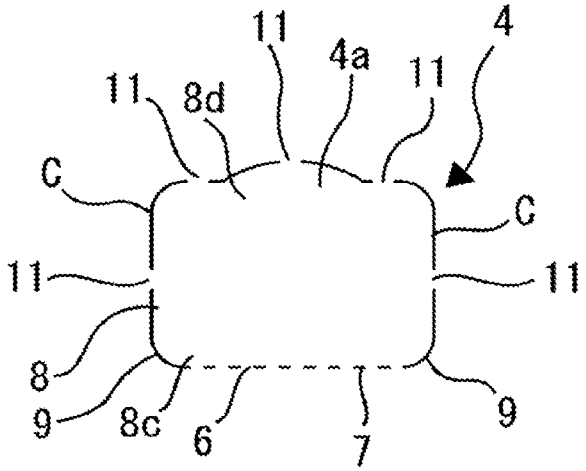
FIG. 5 is explanatory diagrams for explaining a shape of the inlet/outlet formation part.
Figure 5:
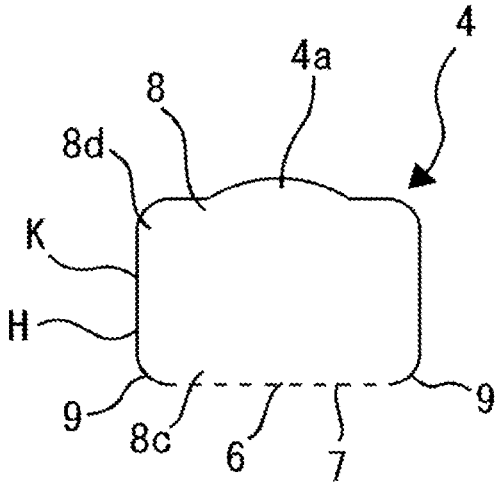

In addition, as illustrated in FIGS. 5(*a*) and 5(*b*), the inlet/outlet formation part 4 has a roughly rectangular shape, and includes a protrusion part 4*a* that protrudes above another part in a center of an upper end in FIGS. 5(*a*) and 5(*b*). The protrusion part 4*a* has been formed in a direction toward a peripheral edge where the peripheral wall 3*b* has been formed in the top lid body 3*a*. In the inlet/outlet formation part 4, as illustrated, for example, in FIG. 5(*a*), for example, the bending line 7 or the like is formed in a portion where the hinge 6 has been formed, and a cutout line C is formed in a predetermined shape (in FIG. 5(*a*), a roughly rectangular shape) in a portion other than the portion where the hinge 6 has been formed. In a plurality of predetermined portions in the middle of the cutout line C, the top lid body 3*a* and the closing piece 8 are partially joined to each other by a dot-shaped joint 11. It is configured in such a way that by forming the inlet/outlet formation part 4, as described above, when the inlet/outlet formation part 4 is pulled by the sticker member 31 or is pulled up by the sticker member 31, the dot-shaped joint 11 is cut, and joining in the dot-shaped joint 11 is released.

In addition, in the inlet/outlet formation part 4, as illustrated in FIG. 5(*b*), the bending line 7 has been formed in a portion where the hinge 6 has been formed, as described above, and a half-cut part H has been formed in a portion where the hinge 6 has not been formed. The half-cut part H includes a cuttable line K all over the half-cut part H. In addition, the inlet/outlet formation part 4 is formed in such a way that the cuttable line K is formed and the inlet/outlet formation part 4 is not cut in the dot-shaped joint 11. In addition, in a case where a circumference of the inlet/outlet formation part 4 has been formed as the half-cut part H, the inlet/outlet formation part 4 has been formed in such a way that a part like the dot-shaped joint 11 described above is not included and a thickness is only decreased in the entirety of a portion where the half-cut part H has been formed. Note that in a case where the half-cut part H has been formed, it is conceivable that on the cuttable line K, there is no dot-shaped joint and only a portion where the half-cut part H has been formed has been formed, or it is conceivable that the inlet/outlet formation part 4 is formed by using both the half-cut part H and the cutout line C. In addition, the inlet/outlet S is formed by pulling up or pulling the closing piece 8 by using the sticker member 31 to cut the dot-shaped joint 11 or cut the half-cut part H.

As illustrated in FIGS. 5(*a*) and 5(*b*), in the closing piece 8, a stress reduction part 9 has been formed on a base end side 8*c* where the hinge 6 has been formed. The stress reduction part 9 reduces a stress generated against a force applied when the closing piece 8 is pulled up. The stress reduction part 9 is formed in a curve shape extending toward the hinge 6 in the aspect illustrated in FIG. 5(*a*). Stated another way, the stress reduction part 9 has been formed to serve as a cutout that disperses the stress described above, and the cutout has been formed to extend in a direction that is different from a direction of a force applied to the closing piece 8 on the base end side 8*c*. Further, as illustrated in FIGS. 5(*a*) and 5(*b*), the closing piece 8 has a roughly rectangular shape in which a width on the base end side 8*c* where the hinge 6 has been formed is the same as a width of a front end side 8*d* in a position away from the hinge 6.

Figure 7:
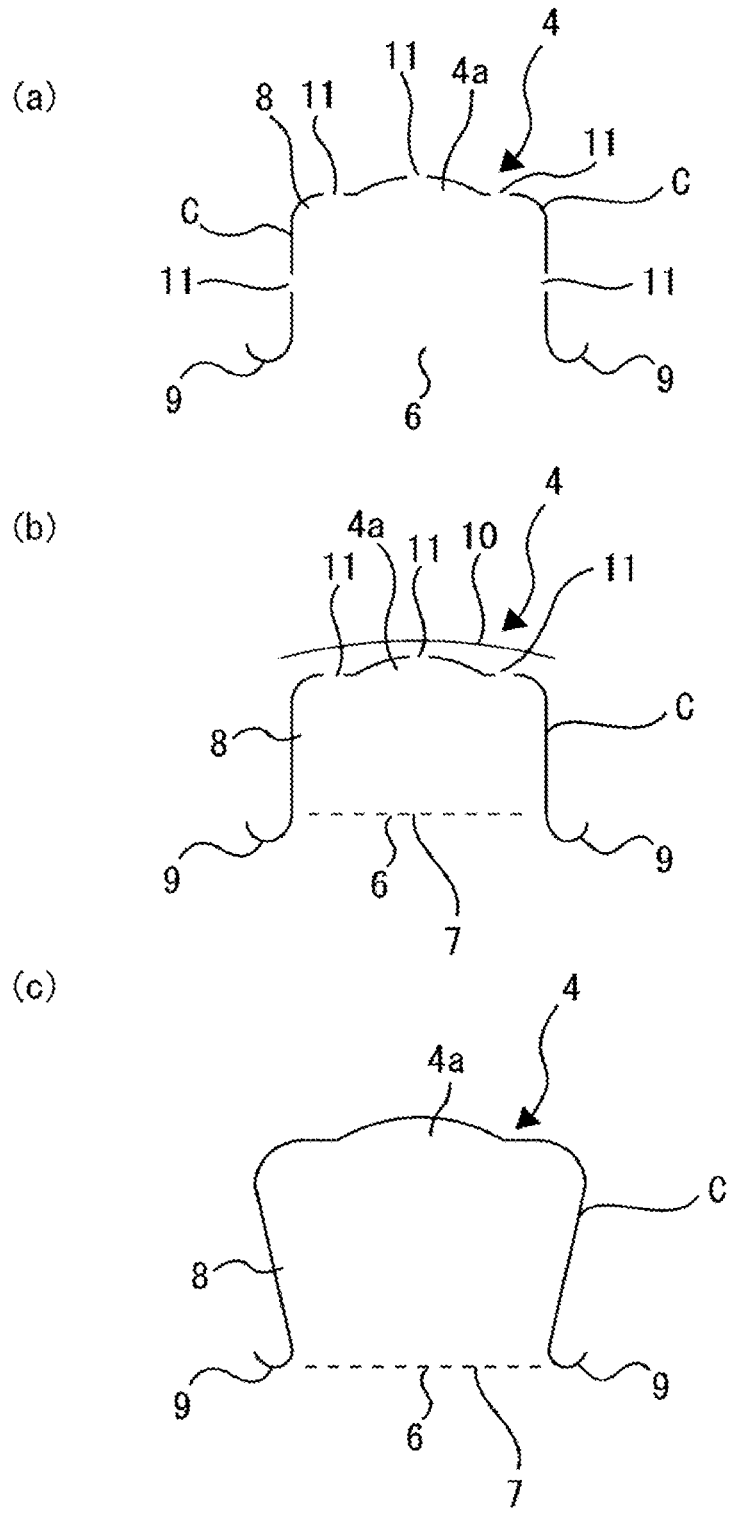
FIG. 7 is explanatory diagrams for explaining variations of a shape of the inlet/outlet formation part, (a) is an explanatory diagram illustrating a first variation, (b) is an explanatory diagram illustrating a second variation, and (c) is an explanatory diagram illustrating a third variation.

FIGS. 7(*a*), 7(*b*), and 7(*c*) illustrate variations of the inlet/outlet formation part 4. Note that specifically, the inlet/outlet formation part 4 has the same shape as a shape of the closing piece 8. In a case where the closing piece 8 is open, the inlet/outlet S also has the same shape. Here, a shape of the inlet/outlet formation part 4 is described, but description is provided under the assumption that the closing piece 8 and the inlet/outlet S are included. First, the inlet/outlet formation part 4 is not limited to the shape described above, and may have, for example, an arbitrarily selected shape, as described in the variations described below. For example, in the inlet/outlet formation part 4 illustrated in FIG. 7(*a*), the dot-shaped joint 11 has been formed in three places in total, one place on one end side serving as a front end side of the inlet/outlet formation part 4 and one place on each of the right-hand and left-hand sides between the one end side and another end side serving as a base end side. In addition, on the other end side serving as the base end side, a cutout line C forming the inlet/outlet formation part 4 has been formed to draw an arc toward the one end side from the other end side. Further, in the present variation, the stress reduction part 9 has been formed on a base end side of the cutout line C. The stress reduction part 9 has been formed in an arc shape, and an end on the base end side of the cutout line C is located above an end on the base end side in the inlet/outlet formation part 4. In addition, the stress reduction part 9 has been formed to be located outside the inlet/outlet formation part 4. By forming the stress reduction part 9, as described above, for example, when the closing piece 8 is moved to open the inlet/outlet S, the top lid 3 can be prevented from being damaged, for example, due to a force applied to the closing piece 8 or the like.

The inlet/outlet formation part 4 illustrated in FIG. 7(*b*) has the same shape as the shape described above of FIG. 7(*a*). In the inlet/outlet formation part 4 illustrated in FIG. 7(*b*), the bending line 7 in addition to the cutout line C has been formed on a base end side, and a bending line 10 has also been formed on a front end side. The bending line 7 has been formed to specify a position where an end on a base end side of the closing piece 8 serving as the inlet/outlet formation part 4 will be bent, when the closing piece 8 serving as the inlet/outlet formation part 4 enters into a rising state (that is, a state where the inlet/outlet S is open) from a lying state (that is, a state where the inlet/outlet S is closed). As described above, by forming the bending line 7 on the base end side of the inlet/outlet formation part 4, a variation in a manner of rising, a rising state, or the like can be effectively controlled when the closing piece 8 serving as the inlet/outlet formation part 4 enters into the rising state.

In addition, by forming the bending line 10 at an end on the front end side of the inlet/outlet formation part 4, a portion where the top lid body 3*a* in which the inlet/outlet formation part 4 has been formed will be bent can be specified. Therefore, when the inlet/outlet formation part 4 moves from a lying state to a rising state, an influence on the end on the front end side of the inlet/outlet formation part 4 can be reduced.

The inlet/outlet formation part 4 illustrated in FIG. 7(*c*) has a shape that is different from the shape of FIG. 7(*a*) in that a width dimension on a front end side is larger than a width dimension on a base end side. By forming the inlet/outlet formation part 4 as described above, the effect described above can be achieved. In addition, for example, in a case where the contents of the container 21 include a solid such as ice or the like, when a user uses the container 21, the inlet/outlet formation part 4 in the present variation can reliably avoid a risk that such a solid such as ice or the like, for example, will suddenly enter the user's mouth. Note that in FIG. 7(*c*), a dot-shaped joint 11 is not illustrated, but the dot-shaped joint 11 may be appropriately provided.

It is more preferable that the dot-shaped joint 11 be formed at least at a forefront end of an end on one end side serving as an end on a front end side. In general, a user's force is applied to the inlet/outlet formation part 4 via the sticker member 31. If the dot-shaped joint 11 has not been formed in the portion described above, there is a risk that a lift will be generated in a portion where a user's force is applied, and the contents of the container 21 will leak out from the inlet/outlet S. Such a risk can be significantly reduced. Note that in the aspects illustrated in FIGS. 7(*a*) to 7(*c*), similarly, the closing piece 8 serving as the inlet/outlet formation part 4 may be formed by forming the cutout line C or by forming the half-cut part H. In addition, the closing piece 8 serving as the inlet/outlet formation part 4 may be formed in an aspect other than these aspects.

As illustrated in FIGS. 3 and 4, the inlet/outlet formation part 4 is provided in a position where the mouth 22 serving as an opening end of the container 21 can be visibly recognized. Specifically, as illustrated in FIG. 3, in a plan view of the lid 1, the inlet/outlet formation part 4 is open, and the inlet/outlet S is also open. At this time, the protrusion part 4*a* of the inlet/outlet S has been provided in a position where the projection part 24 on a side of the container 21 mounted with the lid 1 can be visibly recognized. In particular, in this case, it is preferable that a front end of the inlet/outlet S of the lid 1 be formed to be located at a top of the projection part 24 on a side of the container 21, as also illustrated in FIG. 4. Such formation can eliminate a trouble in which part of a beverage remains in the container, when a user drinks the beverage in the container. Accordingly, the inlet/outlet formation part 4 has been provided in a position away from a center of the top lid body 3*a*.

In addition, the inlet/outlet formation part 4 can be formed by arbitrarily selecting what is called VIC punching or a conventionally known method that corresponds to VIC punching. Further, in order to perform the VIC punching described above to form the inlet/outlet formation part 4, it is preferable that a thickness of a punching blade to be used in a punching process be 1.0 mm or less. More specifically, it is more preferable that the thickness be 0.7 mm or less, and it is further preferable that the thickness be 0.4 mm or less. In a case where the thickness of the punching blade is 0.4 mm or less, the cutout line C is formed, but a gap with the cutout line C is not likely to be generated due to characteristics of a paper material after cutting. Therefore, leakage from the cutout line C can be significantly reduced.

For example, in the case of the lid 1 of a container that holds a beverage, as described in the present embodiment, the inlet/outlet S is an opening that has been formed to function as a mouth for drinking that enables a beverage in the container 21 to flow out from the container 21 when a user drinks the beverage in the container 21. In addition, the inlet/outlet S is an opening that has been formed to function as an insertion opening from which an object such as a straw can be inserted into the inside 23 of the container 21. The inlet/outlet formation part 4 enables such an inlet/outlet S to be formed. As illustrated in FIG. 5 or the like, the inlet/outlet formation part 4 has been formed to have a predetermined size and a predetermined shape on a surface of the top lid body 3*a*, and the inlet/outlet formation part 4 has been formed by forming the cutout line C or the half-cut part H. In various aspects, the cutout line C or the half-cut part H is formed. Therefore, a conventionally known aspect may be appropriately selected and used. In addition, only the cutout line C or only the half-cut part H may be formed as needed. Partially joining may be only performed in the dot-shaped joint 11, and the cutout line C and the half-cut part H may be separately provided in a portion other than the dot-shaped joint 11. Alternatively, an arbitrary combination of the cutout line C, the half-cut part H, and the dot-shaped joint 11 may be formed.

As illustrated in FIG. 1 or the like, the sticker member 31 has been mounted on the inlet/outlet formation part 4. A first joint 32 has been formed at one end 31*a* of the sticker member 31. The first joint 32 is joined to the closing piece 8 included in the inlet/outlet formation part 4, by using various methods including ultrasonic joining, heat sealing, joining using an adhesive, and the like. From among the methods described above, it is preferable that a joining method in the first joint 32 be ultrasonic joining from the viewpoint of easiness of joining, a strength of joining, or the like. A portion on a side of the one end 31*a* where the sticker member 31 has been mounted on the inlet/outlet formation part 4 is located in a position that deviates from a center of the closing piece 8 serving as the inlet/outlet formation part 4, specifically, a position that is away from a center of the top lid 3 in the closing piece 8 serving as the inlet/outlet formation part 4, and more specifically, a position that is farthest from the center of the top lid 3. Stated another way, the sticker member 31 has been mounted in a position close to a side of the one end 8*a* in the closing piece 8. In other words, in the inlet/outlet formation part 4, the sticker member 31 has been formed to be joined to a one end side of the top lid body 3*a*. In particular, it is preferable that the inlet/outlet formation part 4 and the sticker member 31 be joined on a side of the one end 8*a* that is apart from the hinge 6 in the closing piece 8.

As described above, in the closing piece 8 serving as the inlet/outlet formation part 4, if the sticker member 31 is joined in a position that is apart from the hinge 6, a distance to a force point relative to the hinge 6 (a fulcrum) can be increased. By doing this, for example, when the sticker member 31 is being pulled up, a force is applied to the closing piece 8 via the sticker member 31, joining is released in the dot-shaped joint 11 or the half-cut part, and the closing piece 8 can be more easily opened or closed.

Figure 8:
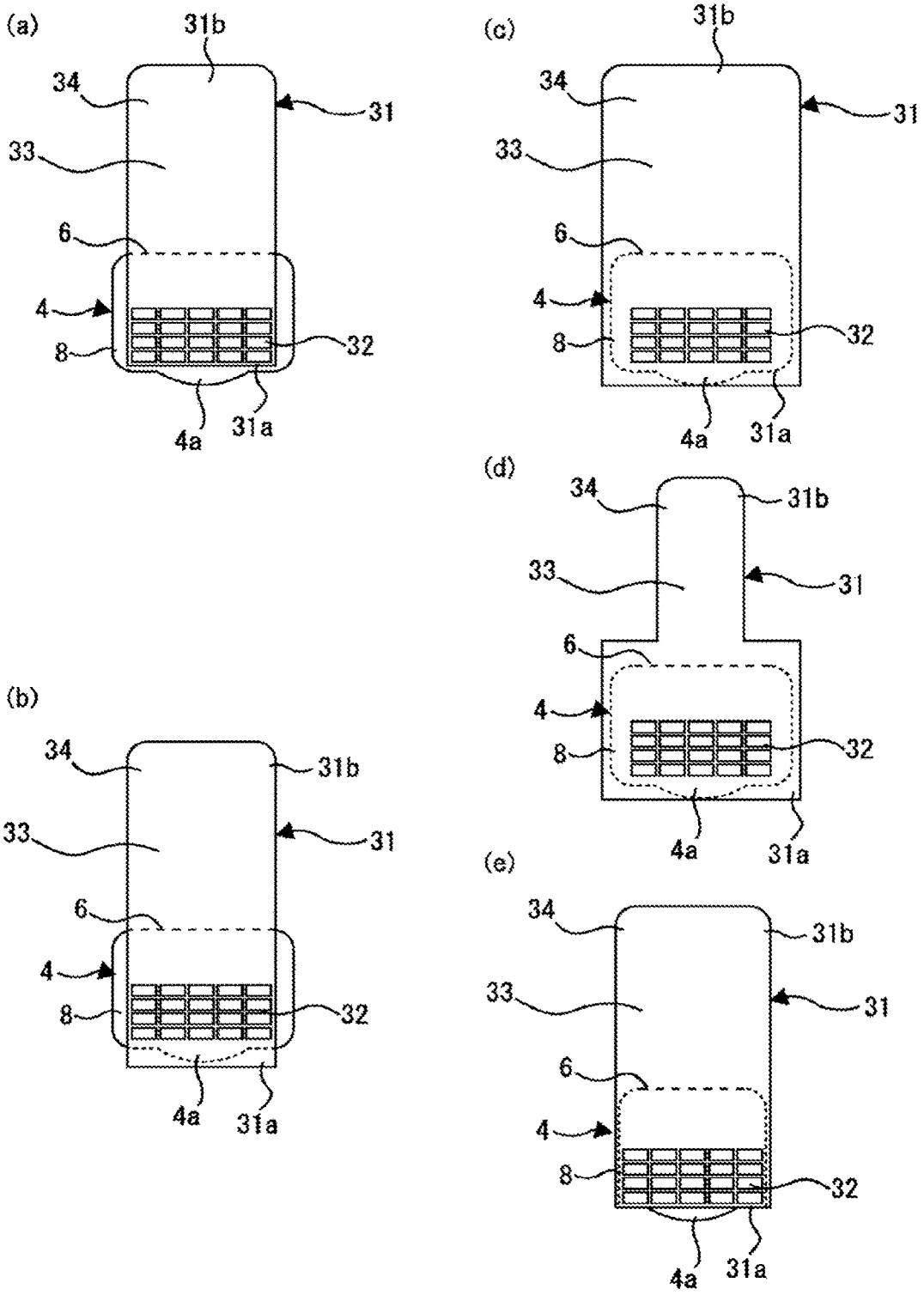
FIG. 8 is explanatory diagrams for explaining variations of an aspect in which a sticker member is mounted.
Figure 9:
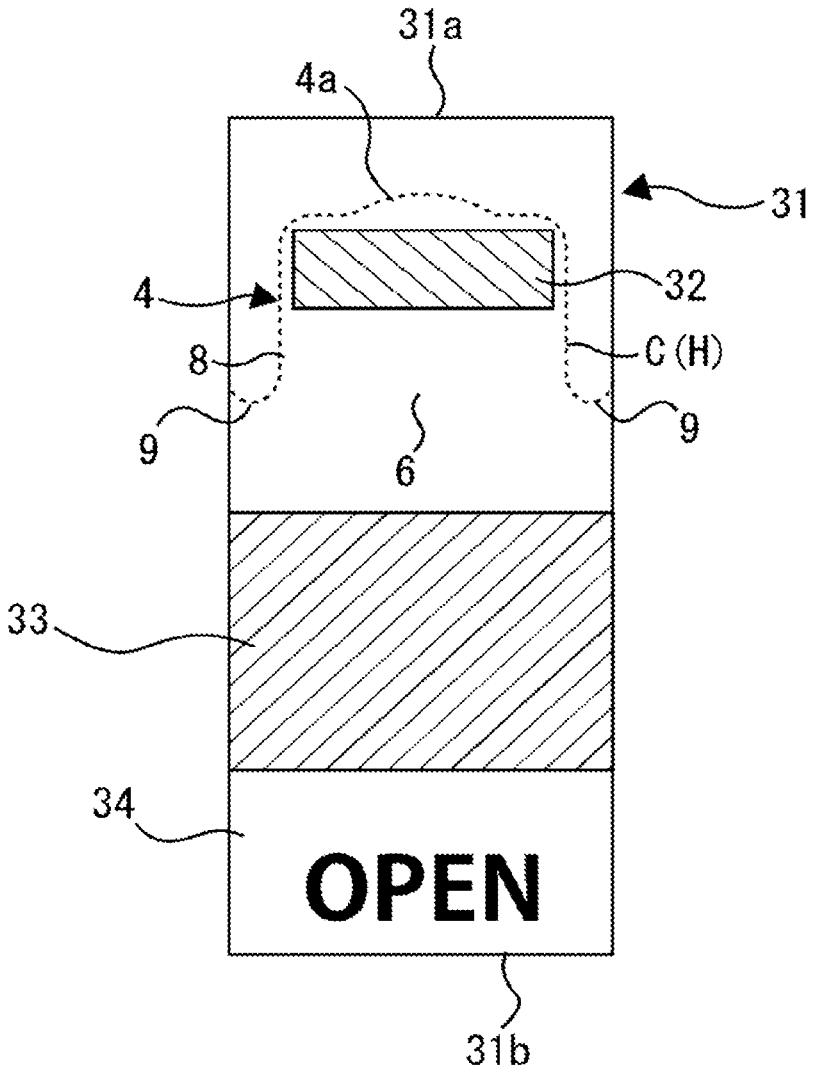
FIG. 9 is an explanatory diagram for explaining another aspect in which a sticker member is mounted.

As illustrated in FIGS. 1, 8, and 9, the sticker member 31 has been mounted in a position that deviates from a center of the inlet/outlet formation part 4 and specifically, in a position closer to the front end side than the center of the inlet/outlet formation part 4. In addition, the sticker member 31 has been mounted in a position that is also apart from a center of the top lid body 3*a* toward a peripheral edge in the inlet/outlet formation part 4. Note that it is preferable that the sticker member 31 be mounted in a position that is farthest from the center of the top lid body 3*a* in the inlet/outlet formation part 4.

Further, the sticker member 31 includes one end 31*a* that has been mounted on the inlet/outlet formation part 4, and another end 31*b* that faces the one end 31*a*. At the other end 31*b* of the sticker member 31, a second joint 33 has been formed. The second joint 33 is joined to a surface of the top lid body 3*a* in a state where an adhesive strength is smaller than an adhesive strength of the first joint 32. The second joint 33 has been formed in a portion that is located close to the other end 31*b* in the sticker member 31 and has a predetermined range. A joining force of the second joint 33 is smaller than a joining force of the first joint 32, and the second joint 33 is joined at a force that enables the sticker member 31 to be easily peeled off from the surface of the top lid body 3*a* at a user's force. Stated another way, the other end 31*b* has been peelably mounted on the surface of the top lid body 3*a* in a predetermined position that is closer to the one end 31*a* by a predetermined distance from the other end of the sticker member 31. In addition, a tab 34 has been formed at the other end 31*b* of the sticker member 31. The tab 34 has been formed as a non-joint that is not joined to the surface of the top lid body 3*a*. In addition, the other end 31*b* has been formed to be mountable again after being peeled off from the surface of the top lid body 3*a*. It is preferable that the sticker member 31 be formed in such a way that a mounting strength of the one end 31*a* is greater than a mounting strength of the other end 31*b*. In an aspect in which the mounting strength of the second joint 33 is made smaller than the mounting strength of the first joint 32, for example, an adhesive having a small strength may be used. Alternatively, even when an adhesive itself has the same strength, adjustment may be performed, for example, by changing an amount of application of the adhesive or a manner of application. Another aspect may be employed, and an arbitrary conventionally known method may be selected and used. Note that in the sticker member 31, a portion having a small adhesive strength (mounting strength) can also be joined again after being peeled off from the top lid body 3*a*. In addition, it is conceivable that a portion having a great adhesive strength, for example, a portion that is joined to the closing piece 8 serving as the inlet/outlet formation part 4 on a side of the one end 31*a* of the sticker member 31, is joined according to an arbitrary conventionally known method. It is preferable that joining be performed by performing ultrasonic joining from among conventionally known methods.

FIG. 8 illustrates variations of the sticker member 31. FIG. 8(*a*) illustrates the example described above of the sticker member 31. FIG. 8(*b*) illustrates an example where in the sticker member 31, the first joint 32 is joined to the closing piece 8 serving as the inlet/outlet formation part 4 and the sticker member 31 further extends to a front end side beyond the first joint 32. In addition, FIG. 8(*c*) illustrates an example where the entirety of the inlet/outlet formation part 4 is covered with the sticker member 31 and is joined. For example, if the entirety of the closing piece 8 serving as the inlet/outlet formation part 4 is covered with the sticker member 31, as illustrated in FIG. 8(*c*), a beverage or the like serving as the contents can be prevented from leaking out to the surface of the top lid body 3*a* from a gap such as the cutout line C or the like that forms a circumference of the closing piece 8. Stated another way, the sticker member 31 can cover the gap described above. By doing this, even in a situation where the container 21 mounted with the lid 1 is relatively likely to swing, for example, at the time of delivery or takeout or in a situation where the container 21 mounted with the lid 1 is likely to be inclined, the sticker member 31 can avoid leakage to the outside of a beverage serving as the contents that are about to lead out to the outside of the top lid body 3*a*. By doing this, a lid 1 that reduces leakage can be provided.

FIG. 8(*d*) illustrates an example where the sticker member 31 has been formed to cover the inlet/outlet formation part 4 and a width of the tab described above that has been formed at the other end is reduced. This can more reliably avoid, for example, leakage of the beverage described above serving as the contents, and a user can easily hold the other end 31*b* and can easily perform an operation. Further, FIG. 8(*e*) illustrates an example where a front end portion of the sticker member 31 is flush with a front end of the inlet/outlet formation part 4. By doing this, similarly, a function of the sticker member 31 can be effectively exhibited.

In addition, the sticker member 31 illustrated in FIG. 9 has been formed in such a way that the entirety of the inlet/outlet formation part 4 is covered, an adhesive part at one end of the sticker member 31 (in FIG. 9, a portion hatched in a small horizontally long rectangular shape) has a great adhesive strength, and an adhesive part at another end of the sticker member 31 (in FIG. 9, a portion that is located below the hatched portion described above and is illustrated in a horizontally long rectangular shape that is larger than the hatched portion described above) has a small adhesive strength and can be peeled off again. If such formation is employed, the entirety of the inlet/outlet formation part 4 is covered with the sticker member 31. This can reliably avoid a trouble of leakage to the outside of a beverage serving as the contents, for example, even at the time of delivery.

Figure 10:
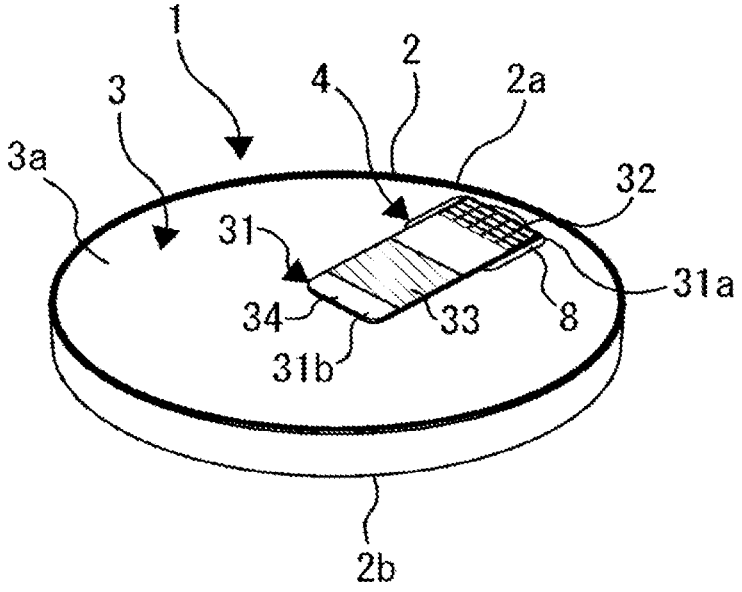
FIG. 10 is external perspective views of a second embodiment of a lid according to the present invention.
Figure 10:
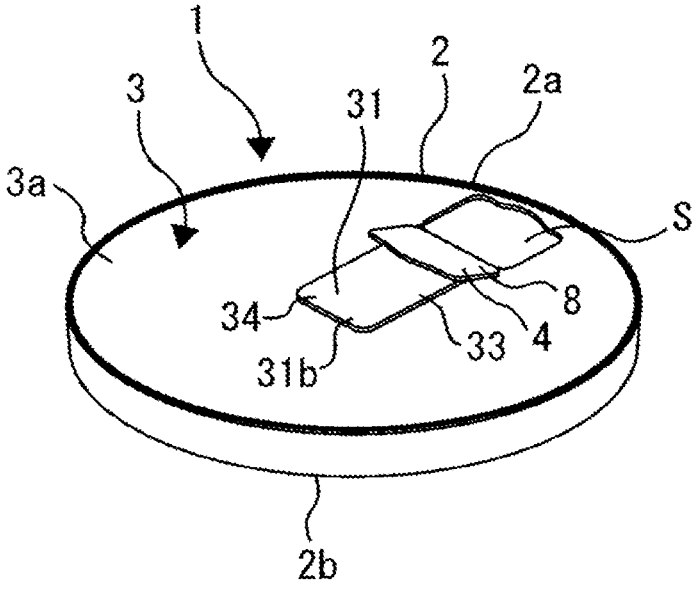

Note that FIG. 10 is a diagram illustrating a second embodiment. FIG. 10 illustrates an example of a lid in which a side wall 2 does not include an upper end side of the side wall 2 described above and the side wall 2 has not been formed to protrude from a top lid body 3*a* in a top lid 3. The present invention can also be applied to a lid 1 having such a shape.

Figure 6:
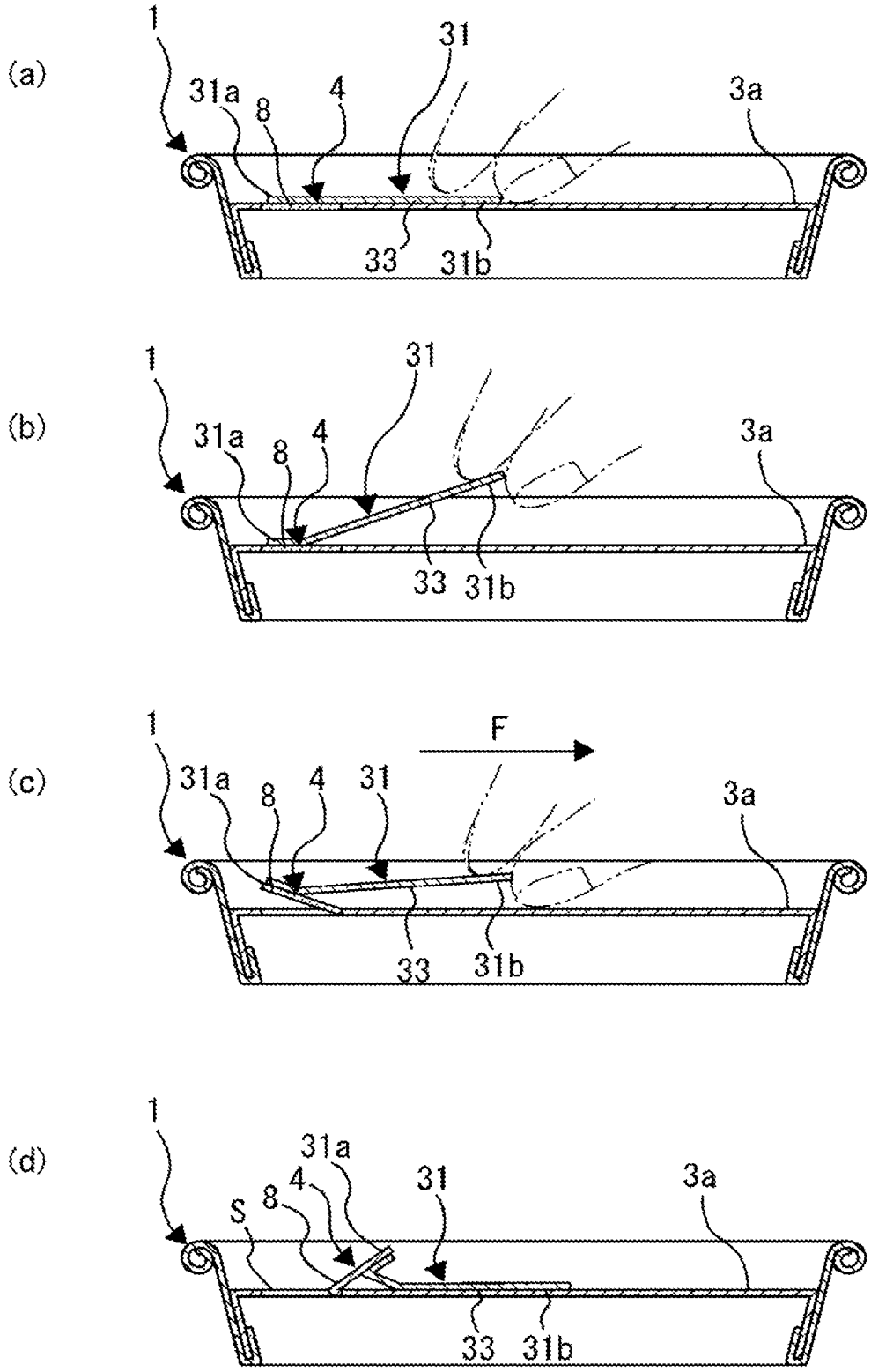
FIG. 6 is explanatory diagrams for explaining effects of the lid.

The lid 1 according to the present embodiment is normally in the state illustrated in FIG. 6(*a*). Stated another way, the sticker member 31 is joined to a surface of the top lid body 3*a* of the top lid 3, and the closing piece 8 serving as the inlet/outlet formation part 4 is closed. In such a state, a user holds the tab 34, and peels off a sticker in the second joint 33 that adheres to a side of the other end 31*b* of the sticker member 31. FIG. 6(*b*) illustrates a state where the sticker in the second joint 33 has been peeled off, as described above. As illustrated in FIG. 6(*c*), when a user pulls the sticker in the second joint 33 in a direction opposite to a portion where the closing piece 8 serving as the inlet/outlet formation part 4 has been formed (in FIG. 6, an F direction) after the user has peeled off the sticker, a tensile force in the F direction acts on the closing piece 8 serving as the inlet/outlet formation part 4 via the sticker member 31. At this time, in a position close to a front end of the closing piece 8 serving as the inlet/outlet formation part 4, the sticker member 31 has been strongly joined in the first joint 32 by performing ultrasonic joining or the like. Therefore, the closing piece 8 serving as the inlet/outlet formation part 4 operates in a direction in which the inlet/outlet S is opened, by using the hinge 6 as a fulcrum. Then, as illustrated in FIG. 6(*d*), the closing piece 8 serving as the inlet/outlet formation part 4 operates until the inlet/outlet S is open. Finally, when the closing piece 8 serving as the inlet/outlet formation part 4 has finished operation as described above, a user sticks the sticker member 31 on a surface of the top lid body 3*a* again. At this time, the sticker in the second joint 33 can adhere again after having been peeled off, and the sticker can be peeled off again, and can adhere again. Therefore, even if the sticker has been peeled off, the sticker can adhere again.

As described above, a lid 1 according to the present invention includes a closing piece 8 serving as an inlet/outlet formation part 4. Therefore, leakage of a beverage or the contents to an outside of the container 21 can be significantly reduced, and a configuration that is conscious of environmental issues can be achieved. In addition, the inlet/outlet formation part 4 normally covers an inlet/outlet S, and therefore an effect of insulating a beverage serving as the contents from heat can be achieved.

Next, a third embodiment of a lid 1 according to the present invention is described. Note that a description of a lid according to the present embodiment that is similar to the description above is omitted, and the same reference signs are used.

Figure 11:
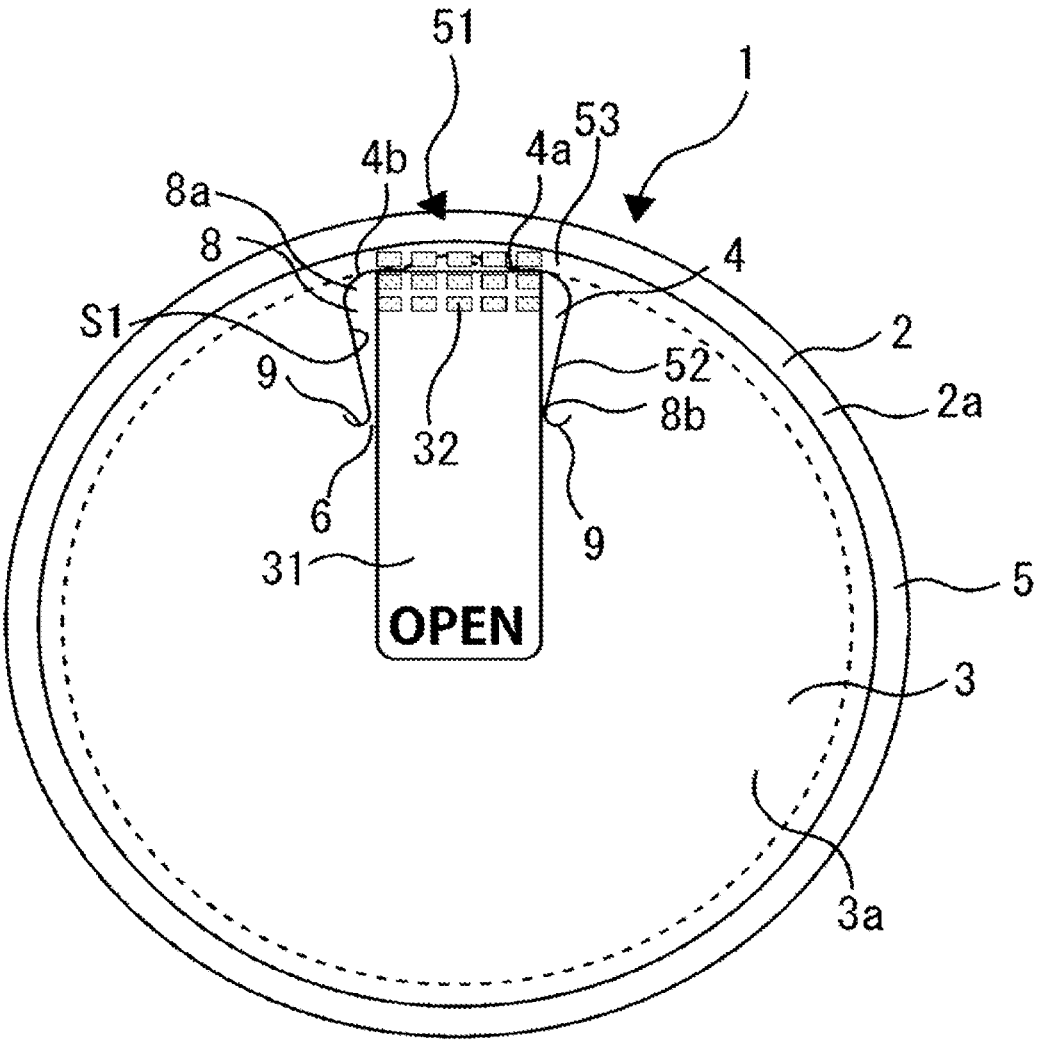
FIG. 11 is a plan view illustrating a third embodiment of a lid according to the present invention.

As illustrated in FIG. 11, the lid 1 according to the present embodiment closes a mouth of a container (not illustrated). The lid 1 is made of a material principally including a paper material, and includes a side wall 2 that is fitted into the mouth of the container, and a top lid 3 surrounded by the side wall 2. In addition, the top lid 3 includes an inlet/outlet formation part 4 that forms an inlet/outlet S of the article stored in the container described above, and a temporary fixing part 51 that temporarily fixes the inlet/outlet formation part 4 to the top lid 3. Further, the top lid 3 includes a cutout 52 between an inner edge S1 of the inlet/outlet S and an outer edge 4*b* of the inlet/outlet formation part 4. Furthermore, the top lid 3 includes a top lid edge 53 in a position closer to a side wall 2 than the inlet/outlet formation part 4, and the cutout 52 has been formed between the outer edge 4*b* of the inlet/outlet formation part 4 and an inner edge of the top lid edge 53.

The temporary fixing part 51 described above has been formed over the inlet/outlet formation part 4, the cutout 52, and the top lid edge 53 in FIG. 11. In addition, the temporary fixing part 51 is temporarily fixed to surfaces of the inlet/outlet formation part 4 and the top lid 3.

Figure 12:
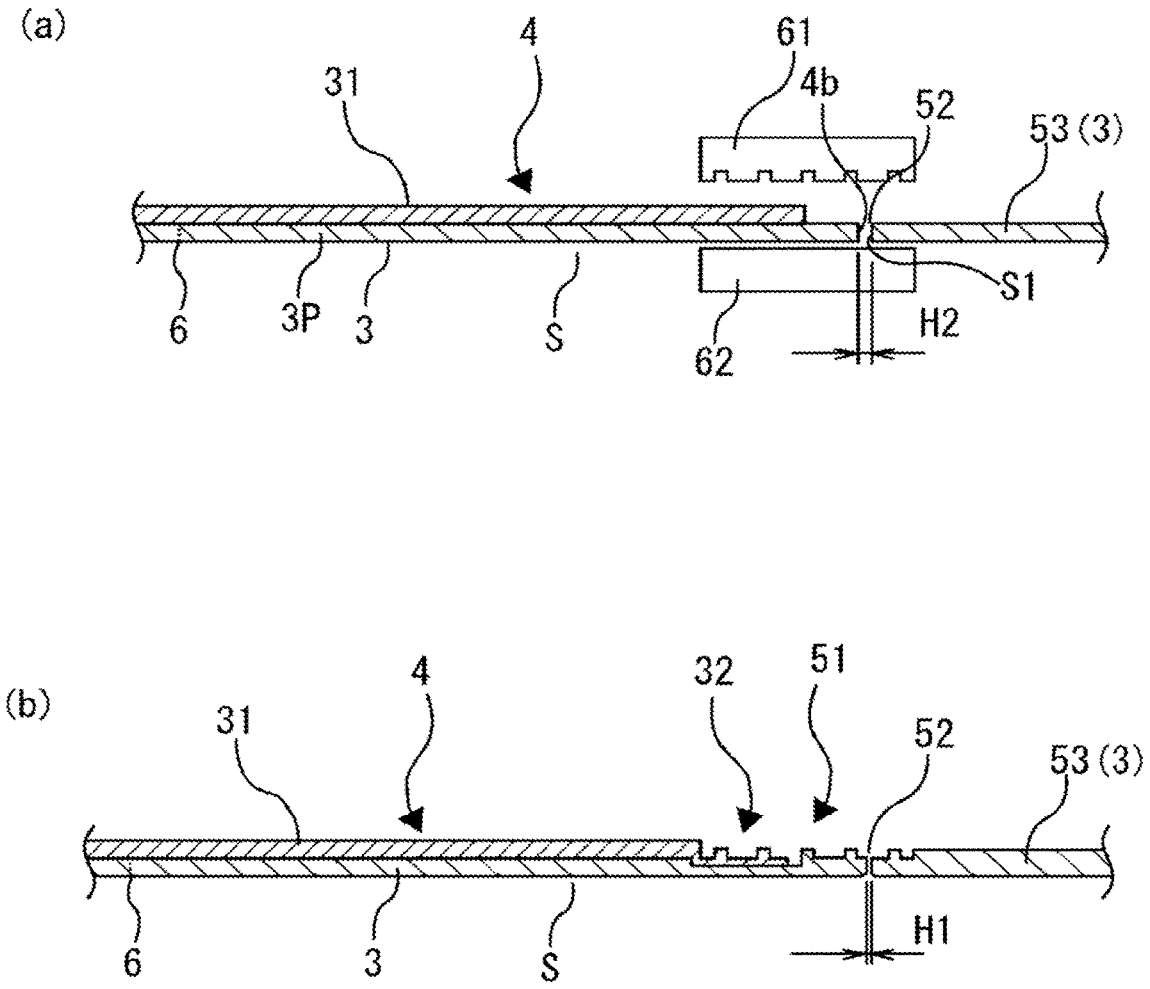
FIG. 12 is sectional views of the lid according to the third embodiment, (a) is a view illustrating a state before formation of a joint, and (b) is a view illustrating a state after formation of the joint.
Figure 13:
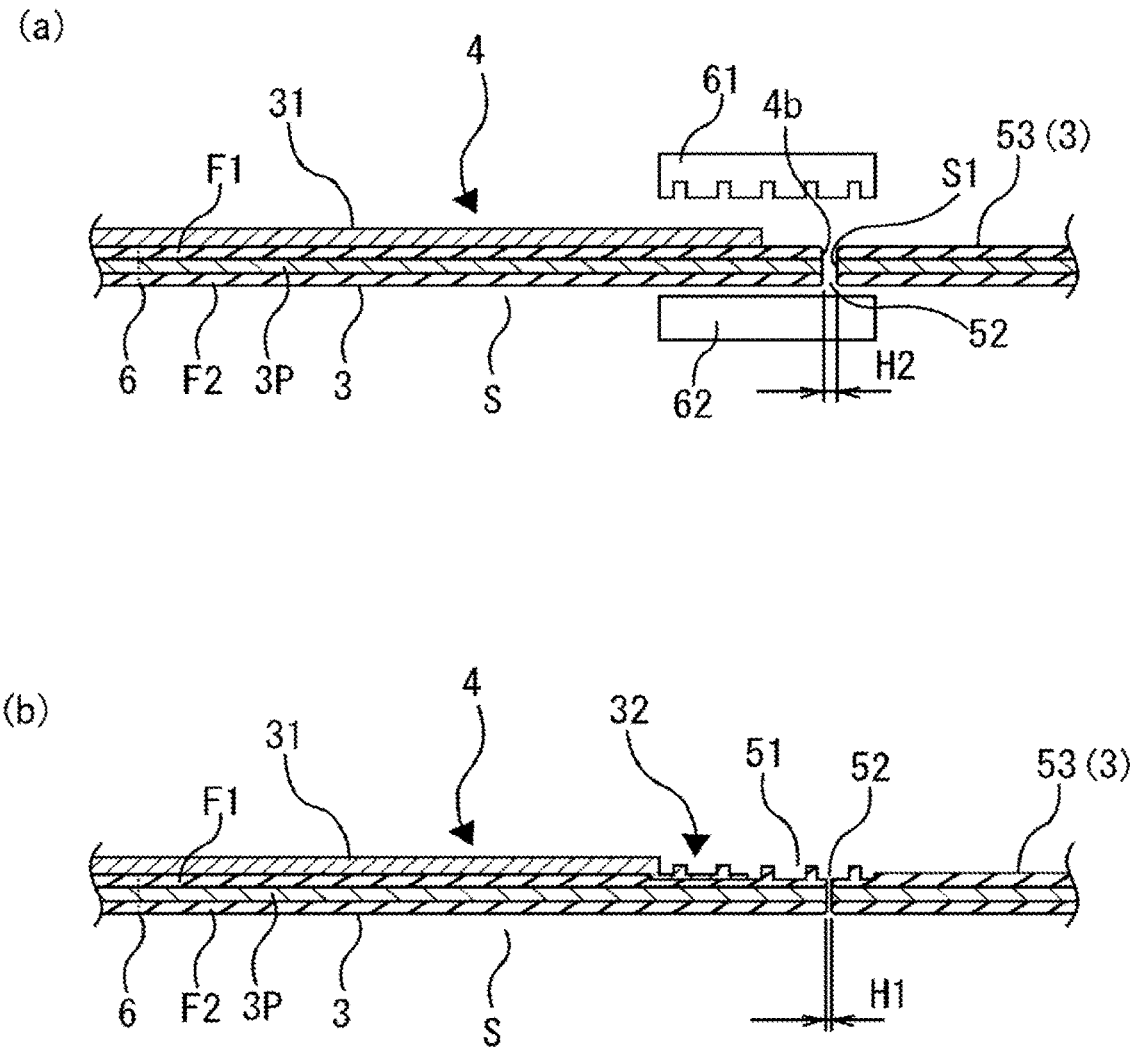
FIG. 13 is sectional views of another aspect of the lid according to the third embodiment, (a) is a view illustrating a state before formation of a joint, and (b) is a view illustrating a state after formation of the joint.

In addition, the cutout 52 has a predetermined width H1 between the inner edge S1 of the inlet/outlet S and the outer edge 4*b* of the inlet/outlet formation part 4. A width H2 of the cutout 52 in a portion where the temporary fixing part 51 has been formed has been formed to be different from a width of the cutout 52 in a portion where the temporary fixing part 51 has not been formed. Stated another way, the cutout 52 has the width H1 in the portion where the temporary fixing part 51 has been formed, and has the width H2 in the portion where the temporary fixing part 51 has not been formed. Then, the widths H1 and H2 have the relationship H2>H1, and the width H1 of the cutout 52 in a portion where the temporary fixing part 51 has been formed has been formed to be smaller than the width H2 of the cutout 52 in a portion where the temporary fixing part 51 has not been formed. Note that as described above, the width H2 of the cutout 52 in a portion where the temporary fixing part 51 has not been formed is the same as a width of the cutout 52 before the temporary fixing part 51 is formed. Therefore, FIGS. 12 and 13 illustrate a width of the cutout 52 in a state before the temporary fixing part 51 is formed.

Note that it is more preferable the width H2 of the cutout 52 in a portion where the temporary fixing part 51 has been formed be small, from the viewpoint of avoiding leakage of the contents. Stated another way, it is preferable that the width H2 of the cutout 52 in a portion where the temporary fixing part 51 has been formed be 0 (zero) and in other words, the inner edge S1 of the inlet/outlet S be in contact with the outer edge 4*b* of the inlet/outlet formation part 4. It is more preferable that the inner edge S1 of the inlet/outlet S be in close contact with the outer edge 4*b* of the inlet/outlet formation part 4 in such a way that a force acts to cause the inner edge S1 and the outer edge 4*b* to push each other. By setting the width of the cutout 52 as described above, the generation of a slight gap between the top lid 3 and the inlet/outlet formation part 4 can be avoided in advance, and this can significantly reduce a risk of leakage of a beverage from the gap in the cutout 52.

Note that temporary fixing part 51 can be formed by selecting and using an arbitrary conventionally known method, such as ultrasonic joining, various types of thermal fusion including heat sealing, joining using an adhesive, or the like. However, it is preferable that the temporary fixing part 51 be formed by using ultrasonic joining from among conventionally known joining methods. In a case where ultrasonic joining is used, in general, as illustrated in FIG. 12(*a*) or FIG. 13(*a*), a horn 61 and an anvil 62 sandwich a target for joining, ultrasonic waves are applied, and joining is performed. By sandwiching a target for joining (in the case of the present invention, for example, the top lid 3) from a front surface and a reverse surface between the horn 61 and the anvil 62 and pressing the target, as illustrated in FIGS. 12 (*b*) and 13(*b*), a paper material 3P forming the top lid 3 can be made to extend in an X direction in FIGS. 12 (*b*) and 13 (*b*). In addition, in a case where various film members, such as a polyethylene film, or the like are laminated on at least one surface of a front surface and a reverse surface of the paper material 3P (in FIG. 13, both the front surface and the reverse surface), these film members F1 and F2 can also be made to extend in the X direction. Therefore, as described above, a width of the cutout 52 is reduced and more preferably, the width is reduced to zero. This easily causes contact or close contact. Accordingly, by using ultrasonic joining to form the temporary fixing part 51, a problem of leakage of a beverage serving as the contents can be avoided more reliably.

The temporary fixing part 51 joins the inlet/outlet formation part 4 (more specifically, the closing piece 8) and the top lid 3 (more specifically, the top lid edge 53) in the top lid 3, as described above. Therefore, the inlet/outlet formation part 4 is temporarily fixed to the top lid 3. However, the temporary fixing part 51 is not limited to such an aspect. In a case where the inlet/outlet formation part 4 is provided with the sticker member 31, as illustrated, for example, in FIG. 11, the one end 31*a* of the sticker member 31 may also be joined. Stated another way, in the embodiment described above, description has been provided by using an example where the inlet/outlet formation part 4 is joined to the sticker member 31 in the first joint 32 by using various methods including ultrasonic joining and the like. However, the temporary fixing part 51 may be formed, for example, by shifting a joining portion of the first joint 32. By employing such formation, the temporary fixing part 51 can also be formed together with the first joint 32, and therefore an efficiency of manufacturing the lid 1 can be significantly improved.

In addition, in a case where the temporary fixing part 51 is formed together with the first joint 32, as described above, a position of the sticker member 31 in the inlet/outlet formation part 4 can be arbitrarily set. However, it is preferable that a position on a side of the one end 31*a* of the sticker member 31 be the same as a position on a front end side of the inlet/outlet formation part 4, or be located closer to the hinge 6 than the position on the front end side. By disposing the sticker member 31 as described above, the first joint 32 and the temporary fixing part 51 can be formed more easily.

As described above, FIG. 12(*a*) schematically illustrates a state where ultrasonic joining is performed, by using an example where the top lid 3 is formed by only using the paper material 3P. As described above, the sticker member 31, the inlet/outlet formation part 4 (the closing piece 8), and the top lid 3 (the top lid edge 53) are sandwiched and pressed by the horn 61 and the anvil 62, and ultrasonic waves are applied. Therefore, joining and temporary fixing can be performed. By performing joining and temporary fixing as described above, a width H2 of a cutout between the inlet/outlet formation part 4 and the top lid 3 changes to a width H1, as illustrated in FIG. 12(*b*), and a width of the cutout 52 decreases. In addition, it is preferable that this width be reduced to zero, as described above. Note that in FIG. 12(*b*), unevenness in a portion where the first joint 32 and the temporary fixing part 51 have been formed is a pattern formed in the horn 61.

FIG. 13(*a*) illustrates an example where the top lid 3 is obtained by laminating and stacking the paper material 3P and the film members F1 and F2. In the case of the top lid 3 formed as described above, similarly to the description above, the horn 61 and the anvil 62 sandwich the top lid 3, and ultrasonic waves are applied. Therefore, the first joint 32 and the temporary fixing part 51 can be formed. In this case, a width of the cutout 52 is similar to the width described with reference to FIGS. 12(*a*) and 12(*b*). Note that in a case where the top lid 3 has a configuration in which the paper material 3P and the film members F1 and F2 have been stacked, as illustrated in FIGS. 13(*a*) and 13(*b*), not only the paper material 3P but also the film members F1 and F2 extend in a direction in which a width of the cutout 52 is reduced, similarly to the paper material 3P. Therefore, the paper material 3P can come into contact so that the width of the cutout 52 is reduced to zero, and the film members F1 and F2 can also come into contact so that the width of the cutout 52 is reduced to zero. This can more effectively avoid leakage of the contents (for example, a beverage or the like) of the container 21.

Figure 14:
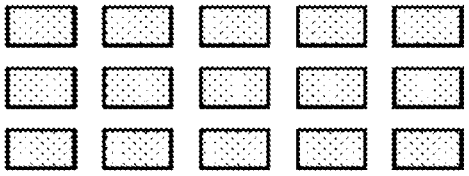
FIG. 14 is schematic diagrams schematically illustrating joining patterns in a joint.
Figure 14:
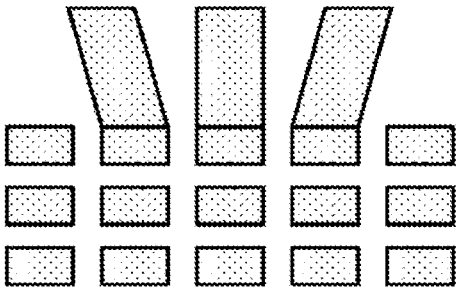

FIG. 14 illustrates examples of a pattern of a horn to be used in ultrasonic joining. As illustrated in FIG. 14(*a*), a pattern obtained by vertically and horizontally arranging a plurality of rectangles may be used. Alternatively, as illustrated in FIG. 14(*b*), a pattern that radially extends may be combined with the pattern obtained by vertically and horizontally arranging a plurality of rectangles. In addition, these two patterns are not restrictive, and an arbitrary pattern may be appropriately selected and used.

Figure 15:
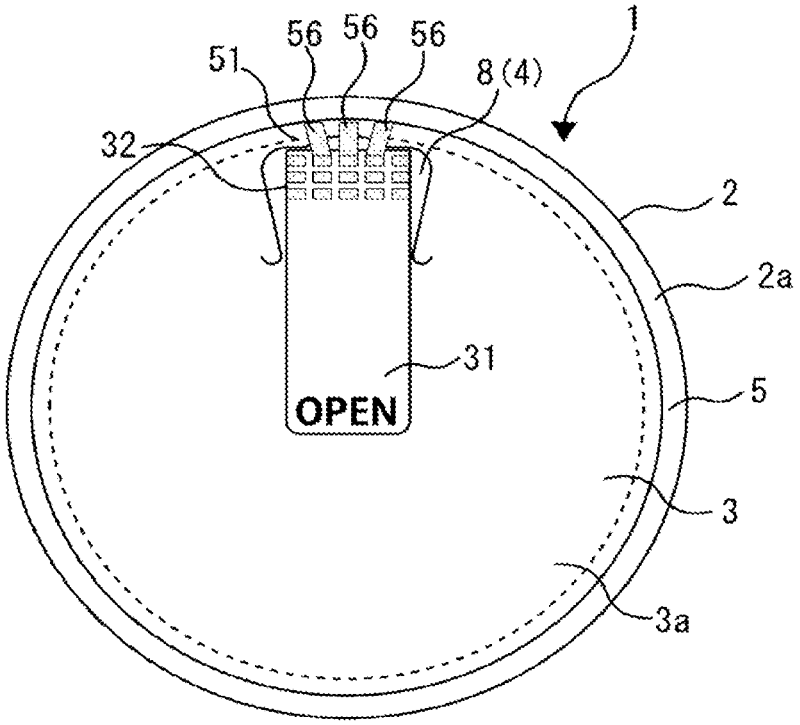
FIG. 15 is explanatory diagrams illustrating variations of the lid according to the third embodiment, (a) is a diagram illustrating a state where an inlet/outlet formation part is closed, and (b) is a diagram illustrating a state where the inlet/outlet formation part is open.
Figure 15:
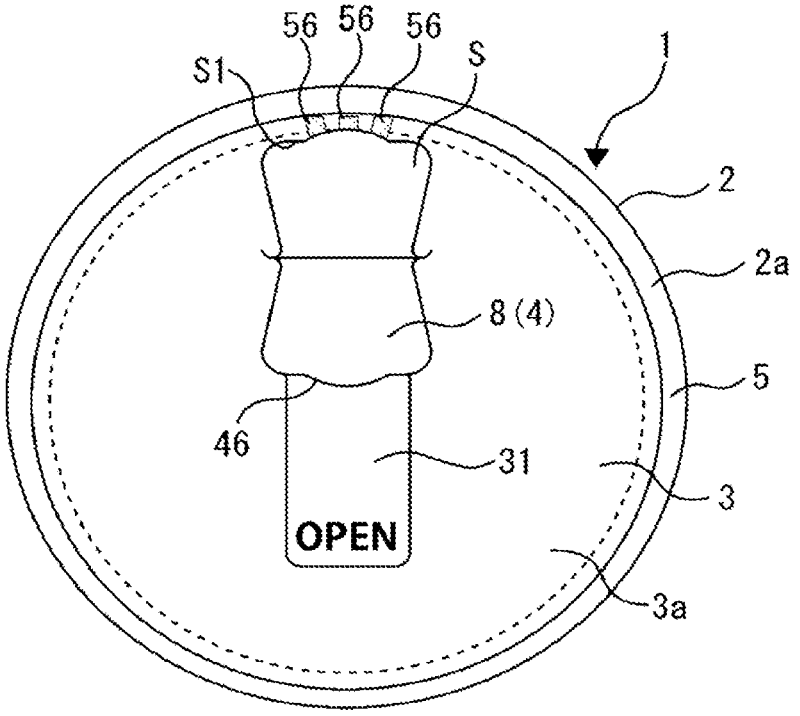

Effects in a case where ultrasonic joining is performed by using the pattern illustrated in FIG. 14(*b*) are described. In a case where this pattern is used, in the top lid 3, from among the patterns described above, the pattern that radially extends can be formed at the top lid edge 53, as illustrated in FIG. 15(*a*). In addition, if ultrasonic joining is used, a paper material forming the top lid 3 is pressed, as described above. Therefore, the pattern is formed in a groove shape on a surface of the top lid 3. The pattern formed in the groove shape serves as a guiding part 56. For example, in a case where a beverage serving as the contents of the container 21 is coming out to an outside of the container 21, the guiding part 56 can guide the beverage through the inlet/outlet S to an inside of the container 21 in such a way that the beverage does not remain at the top lid edge 53. Accordingly, a beverage does not remain at the top lid edge 53, and the lid 1 can be used in a clean state. In addition, clothes or hands are not made dirty due to a beverage remaining at the top lid edge 53, and therefore a risk of feeling uncomfortable can be further reduced, and use without feeling uncomfortable can be achieved.

Note that by forming the first joint 32 and the temporary fixing part 51 as described above, a longer distance can be secured between the hinge 6 and the first joint 32. As described above, by securing a longer distance between the hinge 6 and the first joint 32, the inlet/outlet formation part 4 can be opened more easily in a case where the other end of the sticker member 31 is pulled to open the inlet/outlet formation part 4. For example, by employing such formation, the inlet/outlet formation part 4 can also be opened at a smaller force.

A lid according to the present invention has been described in detail above. However, the description above is merely examples of a lid according to the present invention, and a lid according to the present invention is not limited to the examples described above. Accordingly, a lid according to the present invention can be appropriately modified without departing from the spirit of the present invention.

REFERENCE SIGNS LIST

1 Lid
2 Side wall
2*a* Upper end
2*b* Lower end
2*c* Bent piece
3 Top lid
3*a* Top lid body
3*b* Peripheral wall
4 Inlet/outlet formation part
5 Projection part
6 Hinge
7 Bending line
8 Closing piece
8*a* One end
8*b* Another end
8*c* Base end side
8*d* Front end side
9 Stress reduction part
11 Dot-shaped joint
21 Container
22 Mouth
23 Inside
24 Projection part
25 Rising part
31 Sticker member
31*a* One end
31*b* Another end
32 First joint
33 Second joint
34 Tab
51 Temporary fixing part
52 Cutout
53 Top lid edge

The invention claimed is:

1. A lid for closing a mouth of a container, the lid comprising:
- a top lid having an inlet/outlet formation part forming an inlet/outlet for an article stored in the container;
- a closing piece for closing the inlet/outlet; and
- a sticker member including a first end and a second end opposite the first end, the sticker member being mounted to the inlet/outlet formation part, wherein:
  - the lid is made of a material principally including a paper material;
  - a part of the first end of the sticker member is joined to the closing piece;
  - the second end is located closer to a center of the top lid than the first end and includes a tab;
  - the closing piece includes:
    - a free end located away from the center of the top lid;
    - a fixed end fixed to the center of the top lid;
    - a hinge provided at the fixed end of the closing piece configured to open and close the closing piece; and
- the tab is configured to be grasped.

2. The lid according to claim 1, wherein the sticker member is mounted to the inlet/outlet formation part at a position that deviates from a center of the inlet/outlet formation part.

3. The lid according to claim 2, wherein the sticker member is mounted to the inlet/outlet formation part at a position away from a center of the top lid.

4. The lid according to claim 1, wherein the second end is mounted on a surface of the top lid in a peelable state.

5. The lid according to claim 4, wherein the second end is mounted on the surface of the top lid in the peelable state such that a predetermined distance from the second end is not joined to the surface of the top lid.

6. The lid according to claim 4, wherein the second end is formed to be mountable again after being peeled off from the surface of the top lid.

7. The lid according to claim 4, wherein in the sticker member, a mounting strength at the first end is greater than a mounting strength at the second end.

8. The lid according to claim 1, wherein the tab is not joined to a surface of the top lid.

9. The lid according to claim 1, wherein the sticker member is provided to cover at least a part of the inlet/outlet formation part.

10. The lid according to claim 1, wherein the sticker member has a width that is greater than or equal to a width of the inlet/outlet formation part.

11. The lid according to claim 1, wherein the sticker member is disposed such that the first end extends over an end of the inlet/outlet formation part.

12. The lid according to claim 1, the first end is joined to a surface of the top lid.

13. The lid according to claim 1, wherein the first end is not joined to a surface of the top lid.

14. A kit, comprising:

the container having a mouth; and the lid according to claim 1 for closing the mouth of the container.

15. The lid according to claim 1, wherein;

the sticker member further comprises a first joint and a second joint;

the first joint is joined by a joining method; and the joining method is selected from a group consisting of ultrasonic joining, heat sealing, and joining using adhesive.

16. The lid according to claim 15, wherein the second joint has an adhesive strength that is smaller than the first joint.

17. The lid according to claim 1, wherein the closing piece is defined by a bending line extending from the inlet/outlet formation part.

18. The lid according to claim 1, wherein:

the inlet/outlet formation part defines a bending line; and a hinge provided at the second end of the closing piece is configured to open and close the closing piece, the hinge extending from the bending line.

19. The lid according to claim 1, wherein when the tab is pulled, the first end and the second end are lifted from the lid such that the first end is configured to expose the inlet/outlet.

20. The lid according to claim 1, wherein:

when the first end covers the inlet/outlet, the second end is mounted at a first position; and when the tab is pulled, the second end is configured to be mounted at a second position that is different from the first position.

21. The lid according to claim 1, wherein:

the inlet/outlet formation part of the top lid defines long edges and short edges of the inlet/outlet; and the hinge extends continuously from one of the long edges of the inlet/outlet.

22. A lid for closing a mouth of a container, the lid comprising:

a top lid having an inlet/outlet formation part; wherein:

the inlet/outlet formation part forms an inlet/outlet for an article stored in the container;

the inlet/outlet formation part includes a bending line and a hinge; and a closing piece for closing the inlet/outlet formation part, wherein:

when the closing piece is provided in an open configuration, the inlet/outlet formation part defines an opening and the closing piece is configured to hinge at the bending line such that the hinge forms an edge of the opening;

the closing piece includes a free end spaced from a center of the top lid and a fixed end fixed to the center of the top lid; and a sticker member, wherein:

the sticker member includes a first end and a second end oppositely located to each other mounted to the inlet/outlet formation part;

a part of the first end of the sticker member is joined to the closing piece;

the second end of the sticker member is located closer to the center of the top lid than the first end of the sticker member and includes a tab configured to be grasped.

23. The lid according to claim 22, wherein the bending line defines the mouth of the container and the hinge.

* * * * *